US006905386B2

(12) United States Patent
Thai

(10) Patent No.: US 6,905,386 B2
(45) Date of Patent: Jun. 14, 2005

(54) APPARATUS AND METHOD FOR DELIVERING BUBBLE SOLUTION TO A DIPPING CONTAINER

(75) Inventor: Douglas Thai, Walnut, CA (US)

(73) Assignee: Arko Development Limited (HK)

( * ) Notice: Subject to any disclaimer, the term of this patent is extended or adjusted under 35 U.S.C. 154(b) by 0 days.

(21) Appl. No.: 10/724,647

(22) Filed: Dec. 1, 2003

(65) Prior Publication Data

US 2004/0198134 A1 Oct. 7, 2004

Related U.S. Application Data

(63) Continuation-in-part of application No. 10/133,195, filed on Apr. 26, 2002, now Pat. No. 6,659,831, which is a continuation-in-part of application No. 10/099,431, filed on Mar. 15, 2002, now Pat. No. 6,659,834.

(51) Int. Cl.[7] ..... A63H 33/28

(52) U.S. Cl. ..... 446/15; 446/74; 446/16

(58) Field of Search ..... 446/15–21, 74, 446/180, 183; 222/212, 206, 207; 239/327

(56) References Cited

U.S. PATENT DOCUMENTS

| | | | | | |
|---|---|---|---|---|---|
| 2,560,582 | A | | 7/1951 | Limber | |
| 2,659,177 | A | | 11/1953 | Kopf | |
| 2,974,438 | A | | 3/1961 | Hopkins | |
| 3,420,412 | A | * | 1/1969 | Greene | |
| 3,579,898 | A | | 5/1971 | Hein | |
| 3,604,144 | A | | 9/1971 | Span | |
| 3,736,694 | A | | 6/1973 | Lebensfeld | |
| 4,423,565 | A | | 1/1984 | Bart | |
| 4,700,965 | A | | 10/1987 | Kinberg | |
| 4,804,346 | A | * | 2/1989 | Sheng | 446/17 |
| 4,851,303 | A | | 7/1989 | Madou et al. | |
| 4,957,464 | A | | 9/1990 | Perez | |
| 4,988,319 | A | * | 1/1991 | Shen | 446/19 |
| 5,230,648 | A | * | 7/1993 | Kelley et al. | 446/74 |
| 5,395,274 | A | | 3/1995 | Myers | |
| 5,498,191 | A | | 3/1996 | DeMars | |
| 5,542,869 | A | | 8/1996 | Petty | |
| 5,613,890 | A | | 3/1997 | DeMars | |
| 5,850,945 | A | * | 12/1998 | Frankel | 222/212 |
| 5,879,218 | A | | 3/1999 | Tao | |
| 6,062,935 | A | | 5/2000 | Gross | |
| 6,149,486 | A | | 11/2000 | Thai | |
| 6,200,184 | B1 | | 3/2001 | Rich et al. | |
| 6,331,130 | B1 | | 12/2001 | Thai | |
| 6,343,712 | B1 | * | 2/2002 | Flackett et al. | 222/78 |

* cited by examiner

*Primary Examiner*—Jacob K. Ackun
*Assistant Examiner*—Jamila Williams
(74) *Attorney, Agent, or Firm*—Raymond Sun

(57) ABSTRACT

An apparatus and method of delivering bubble solution to a bubble solution dipping container are disclosed. The apparatus has a housing, a dipping chamber associated with the housing, a source of bubble solution and a tube coupling the source of bubble solution with the dipping chamber. The tube has one end positioned inside the dipping chamber and another end coupled to the source of the bubble solution. A blocking ceiling can be positioned in the dipping chamber over the end of the tube so as to deflect bubble solution ejected from the end of the tube into the dipping chamber.

17 Claims, 17 Drawing Sheets

APPARATUS AND METHOD FOR DELIVERING BUBBLE SOLUTION TO A DIPPING CONTAINER

RELATED CASES

This is a continuation-in-part of Ser. No. 10/133,195, entitled "Apparatus and Method for Delivering Bubble Solution to a Dipping Container", filed Apr. 26, 2002 U.S. Pat No. 6,659,831, which is a continuation-in-part of Ser. No. 10/099,431, entitled "Apparatus and Method for Delivering Bubble Solution to a Dipping Container", filed Mar. 15, 2002 U.S. Pat No. 6,659,834, whose disclosures are incorporated by this reference as though fully set forth herein.

BACKGROUND OF THE INVENTION

1. Field of the Invention

The present invention relates to bubble toys, and in particular, to apparatus and methods for delivering bubble solution to a dipping container.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. Nos. 6,149,486 (Thai), 6,331,130 (Thai) and 6,200,184 (Rich et al.). The bubble rings in the bubble generating assemblies in U.S. Pat. Nos. 6,149,486 (Thai), 6,331,130 (Thai) and 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

Another bubble generating assembly is illustrated in U.S. Pat. No. 5,613,890 (DeMars). DeMars uses a battery-operated machine to control a wiper bar to apply bubble solution onto a bubble ring. Although such a design avoids some of the spillage problems described above, the construction of the bubble generating assembly in DeMars is quite complex, which increases the overall cost of the bubble generating assembly. More importantly, the complex construction has many different moving and interengaging parts that increase the likelihood of defects. Sadly, any defect with any part could mean that the entire assembly is not operational. In addition, DeMars uses a single motor which powers two operations: (1) to pump the bubble solution to the wiper bar, and (2) to cause the fan to blow air at the bubble ring. Depending on the size and quality of the motor, the single motor may not be able to simultaneously perform both tasks effectively, which may negatively affect the quality of the bubbles produced by the bubble generating assembly.

Thus, there remains a need to provide apparatus and methods for delivering bubble solution to a dish or other similar dipping container while avoiding the problems described above.

SUMMARY OF THE DISCLOSURE

It is an object of the present invention to provide an apparatus and method for delivering bubble solution to a dipping container.

It is another object of the present invention to provide an apparatus and method for delivering bubble solution to a dipping container in a manner which minimizes spillage of the bubble solution.

It is yet another object of the present invention to provide an apparatus having a simple construction that delivers bubble solution to a dipping container.

It is yet another object of the present invention to provide a soft fan for use with a bubble generating assembly.

The objectives of the present invention are accomplished by providing an apparatus and method of delivering bubble solution to a bubble solution dipping container. The apparatus has a housing, a dipping chamber associated with the housing, a source of bubble solution and a tube coupling the source of bubble solution with the dipping chamber. The tube has one end positioned inside the dipping chamber and another end coupled to the source of the bubble solution. A blocking ceiling can be positioned in the dipping chamber over the end of the tube so as to deflect bubble solution ejected from the end of the tube into the dipping chamber.

The dipping container and bottle of the present invention can be incorporated for use in a wide variety of bubble generating assemblies, as described in greater detail herein.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides an apparatus that includes a dipping container and a conventional bubble solution bottle. The bottle is removably secured to the dipping container. A tube is secured to the dipping container and fluidly communicates between the interior of the bottle and the interior of the dipping container. With the bottle secured to the dipping container, the user can press the wall of the bottle to create a pressure that pushes bubble solution from the bottle through the tube and into the dipping container. The dipping container also has an outlet that communicates with the interior of the bottle. The outlet can be opened and closed at the discretion of the user to allow the unused bubble solution in the dipping container to flow back into the bottle.

Figure 1:
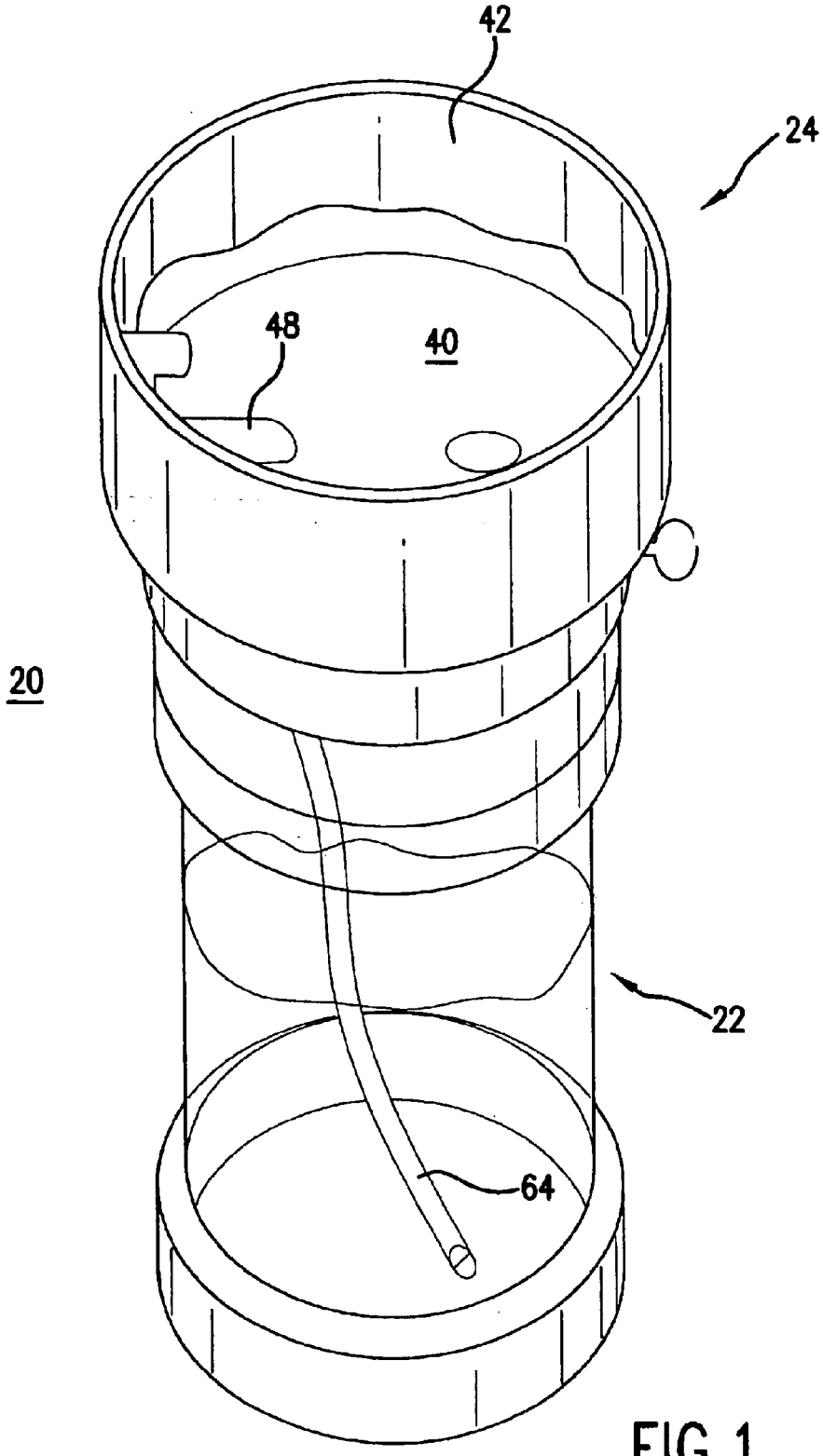
FIG. 1 is a top perspective view of an apparatus that delivers bubble solution to a dipping container according to one embodiment of the present invention.
Figure 2:
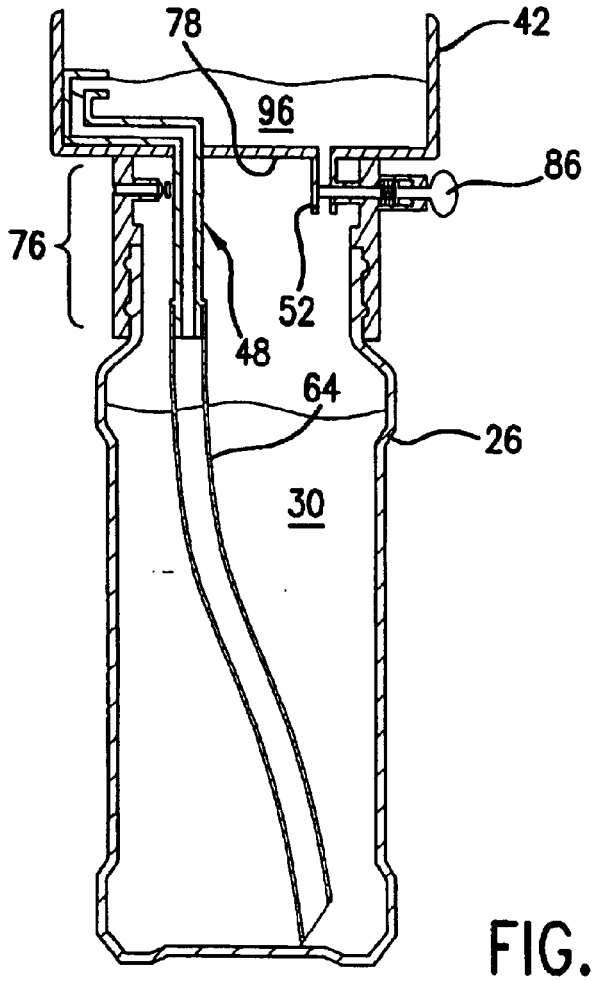
FIG. 2 is a cross-sectional view of the apparatus of FIG. 1.
Figure 3:
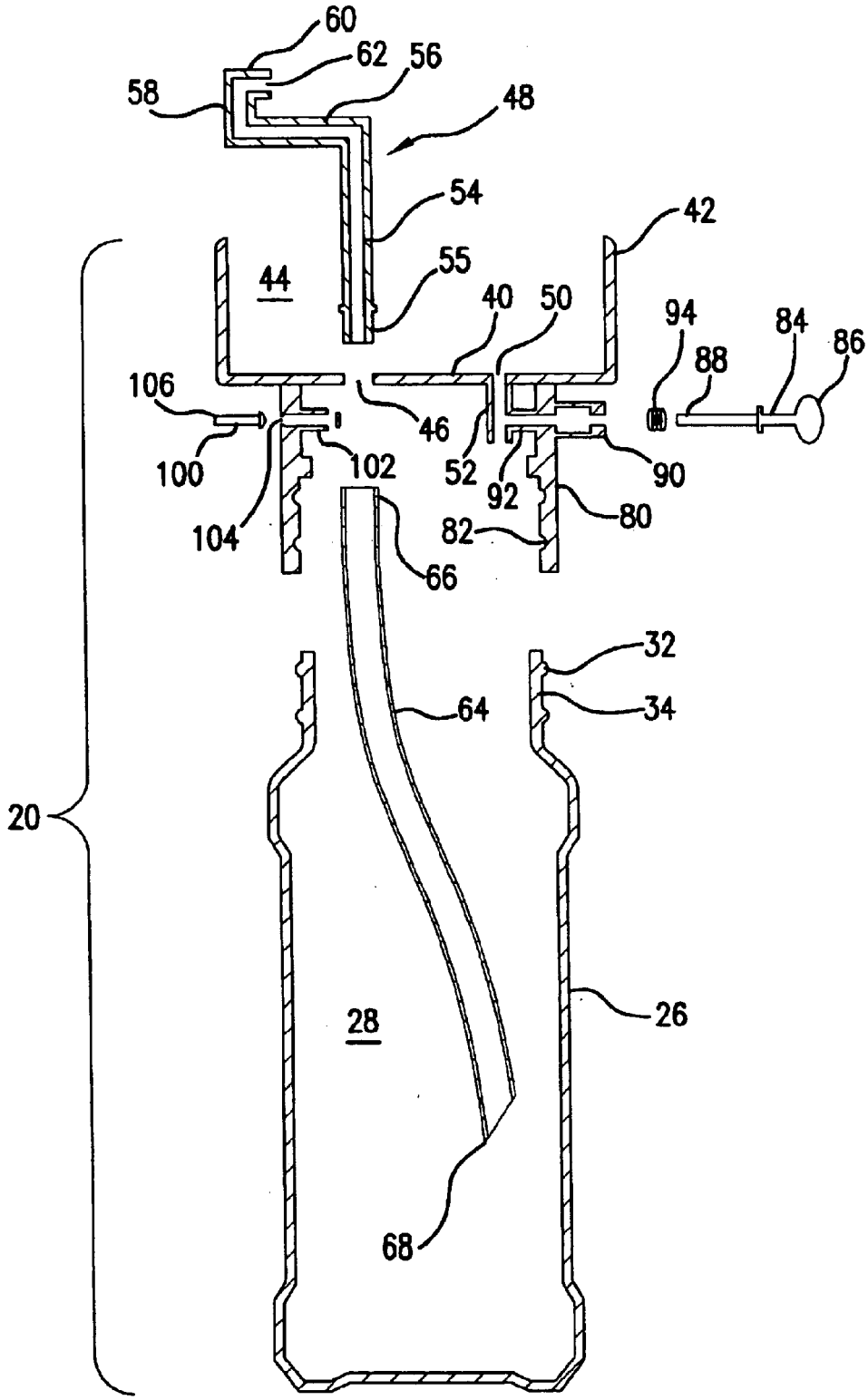
FIG. 3 is an exploded cross-sectional view of the apparatus of FIG. 1.

FIGS. 1–3 illustrate one embodiment of an apparatus 20 according to the present invention. The apparatus has a bubble solution bottle 22 that is removably attached to a dipping container 24, and with the bubble solution bottle 22 being capable of acting as a base to support the entire apparatus 20 in an upright orientation when the bottle 22 is placed on a flat surface. The bottle 22 can take the form of any conventional bubble solution bottle that is commonly available in the marketplace, with one non-limiting example being the bubble solution bottles marketed under the trademarks TOOTSIETOY™ and MR. BUBBLES™ by Strombecker Corp. The bottle 22 has a generally cylindrical wall 26 which is typically made of a soft plastic material that is squeezable by the user. The interior 28 of these bubble solution bottles 22 is typically filled with bubble solution 30, and a cap or lid (not shown) is threadably engaged to the threads 32 on the outer surface of the neck 34 to close the bottle 22. When the bottle 22 is to be attached to the dipping container 24, the cap or lid is removed, and the opened neck 34 is threadably engaged to the dipping container 24 in the manner described below.

The dipping container 24 has a bottom plate 40 and an enclosing wall 42 that together define a dipping chamber 44. The plate 40 and wall 42 can define any shape or size. For example, the plate 40 and wall 42 can be configured so that the wall 42 is circular, oval, square, rectangular, polygonal, or any other irregular shape. The bottom plate 40 has a first opening 46 through which a supply tube 48 is extended, and a second opening 50 which communicates with a feedback channel 52. The first opening 46 can be positioned anywhere on the bottom plate 40.

The supply tube 48 can be made of rubber or injection-molded plastic. The supply tube 48 can be configured to have a first vertical section 54 that extends upwardly from its bottom end 55, a first horizontal section 56 having a first end that extends horizontally from the top of the first vertical section 54, a second vertical section 58 that extends upwardly for a short distance from the opposing second end of the first horizontal section 56, and a second horizontal section 60 having a first end that extends horizontally from the top of the second vertical section 58. The opposing second end 62 of the second horizontal section 60 is opened and communicates with the dipping chamber 44. The first horizontal section 56 can be positioned to lie on the top surface of the bottom plate 40. The supply tube 48 can be configured in the manner shown in FIGS. 2 and 3, and described herein, to optimize the delivery of the bubble solution 30 from the bottle 22 to the dipping chamber 44. Specifically, the second horizontal section 60 aligns its opened end in a horizontal direction so that the bubble solution 30 will be aimed at, and therefore delivered into, the dipping chamber 44. In other words, the various sections 54, 56, 58 and 60 serve to direct the flow of the bubble solution 30 into the dipping chamber 44. As an alternative, it is possible to configure the supply tube 48 with a single vertical section (e.g., with the vertical section 54 and omitting the other sections 56, 58, 60), but the user must be careful not to squeeze the bottle 22 too hard, otherwise the bubble solution 30 may be squirted vertically upwards, and not necessarily into the dipping chamber 44.

A conventional plastic tube 64 can have a first end 66 sleeved over the bottom end 55 of the supply tube 48, and an opposing second end 68 that is adapted to be positioned adjacent the bottom of the bottle 22. As an alternative, the tube 64 can be an extension of (e.g., made in one piece with) the first vertical section 54 of the supply tube 48.

A generally cylindrical connector 76 is provided on the bottom surface 78 of the bottom plate 40. In particular, the connector 76 has a generally cylindrical wall 80 having internal threads 82 that are adapted to threadably engage the external threads 32 on the neck 34 of a conventional bubble solution bottle 22. Depending on the size and shape of the bottom plate 40 and the wall 42 of the dipping container 24, the cylindrical wall 80 can be recessed inside, or extend beyond, the periphery of the bottom plate 40 and the wall 42. A short cylindrical feedback channel 52 is connected to the bottom surface 78 of the bottom plate 40 at the location of the second opening 50.

Figure 4:
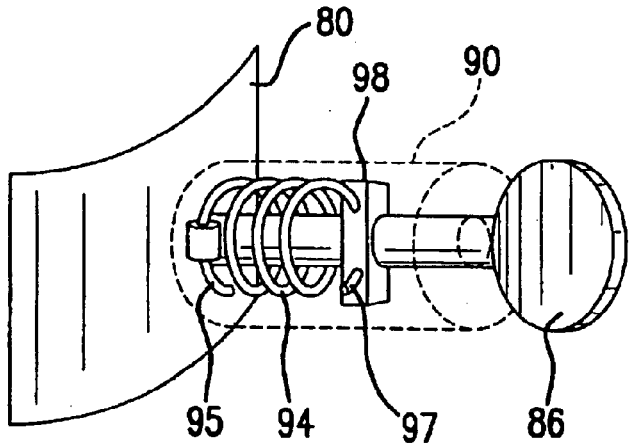
FIG. 4 is an enlarged sectional view of the release handle and spring of the dipping container of FIG. 1.

A release button 84 cooperates with the feedback channel 52 to open and close the feedback channel 52. In particular, the release button 84 has a handle 86 at a first end and a shaft 88 at a second opposing end. A spring housing 90 is provided at a location in the cylindrical wall 80 adjacent to the location of the feedback channel 52. A shaft channel 92 extends through the cylindrical wall 80 and an opening in the feedback channel 52, so as to connect the spring housing 90 with the feedback channel 52. A spring or other biasing element 94 is housed in the spring housing 90. The handle 86 of the release button 84 sits outside the spring housing 90. The shaft 88 of the release button 84 extends through the spring housing 90, the shaft channel 92 and into the feedback channel 52. Referring also to FIG. 4, the spring 94 has a first end 95 that is connected to the wall 80, and an opposing second end 97 that is connected to a protrusion 98 on the shaft 88. The configuration shown in FIG. 4 allows the spring 94 to bias the shaft 88 to block the feedback channel 52 (see FIG. 2) during normal operation. The bias of the spring 94 can be overcome by pulling the handle 86 of the release button 84 in a direction away from the wall 80. Pulling the handle 86 of the release button 84 in a direction away from the wall 80 will also cause the shaft 88 to retract from its blockage of the feedback channel 52, so that the force of gravity will cause the remaining bubble solution 96 in the dipping chamber 44 to flow via the feedback channel 52 into the bottle 22.

A tine suction element 100 is provided in the wall 80 of the connector 76. In particular, a support 102 is provided adjacent another opening 104 in the wall 80, and the suction element 100 is seated for reciprocating movement inside the support 102 and the wall 80. The reciprocating movement of the suction element 100 means that the bottom end 106 of the suction element 100 moves in and out of the opening 104, so that air from outside the bottle 22 can be vented into the interior 28 of the bottle 22 to make it easier to re-inflate and pressurize the the bottle 22.

The dipping container 24 and the connector 76 can be made from any conventional leak-proof and sturdy injection-molded plastic material, including the plastic materials that are currently being used for conventional bubble solution dishes that are available in the market. Other possible materials for the dipping container 24 and the connector 76 include rubber, die-cast metal, cardboard, and non-porous paper materials.

In use, the user removes the cap or lid from a conventional bottle 22 of bubble solution, and threadably connects the neck 34 of the bottle 22 to the interior bore of the wall 80 via the interengaging threads 32 and 82. At this time, as best shown in FIG. 2, the first vertical section 54 of the supply tube 48 extends into the region of the neck 34, and the tube 64 extends into the bubble solution 30. The release button 84 is normally biased by the spring 94 so that its shaft 88 blocks the feedback channel 52. To fill the dipping chamber 44 with bubble solution 30, the user squeezes the wall 26 of the bottle 22, and the pressure generated by the squeeze will cause bubble solution 30 to be pumped or delivered via the tubes 64 and 48 into the dipping chamber 44. With the configuration shown in FIG. 2, the amount of bubble solution 96 in the dipping chamber 44 cannot exceed the height of the second horizontal section 60 of the supply tube 48 because the excess bubble solution will simply flow back into the bottle 22 via the supply tube 48. This feature ensures that the level of the bubble solution 96 in the dipping chamber 44 does not become too high, thereby minimizing the opportunity for spillage.

The user can then dip the bubble ring(s) of any bubble generating device or assembly into the dipping chamber 44 to generate a film of bubble solution across the ring(s). As the bubble solution 96 in the dipping chamber 44 is used up after repeated dippings, the user can squeeze the wall 26 of the bottle 22 to cause more bubble solution 30 from the bottle 22 to be delivered to the dipping chamber 44 to replenish the bubble solution 96. When the user has finished using the bubble solution 96, the user can pull the release button 84 in a direction away from the bottle 22, so that all the bubble solution 96 left in the dipping chamber 44 will flow back into the bottle 22.

Thus, the apparatus 20 of the present invention provides numerous benefits. First, bubble solution 30 can be delivered from a conventional bottle 22 to fill the dipping chamber 44 in a simple and effective manner in which spillage is minimized. Second, the volume of the bubble solution 96 in the dipping chamber 44 is regulated, again to minimize spillage. Third, any unused bubble solution 96 remaining in the dipping chamber 44 can be easily and quickly returned to the conventional bottle 22 with minimal spillage and waste. Fourth, the dipping container 24 can be completely supported on top of the bottle 22 so that the bottle 22 is capable of acting as a base to support the entire apparatus 20 in an upright orientation when the bottle 22 is placed on a flat surface, as shown in FIG. 1, thereby providing a simple and compact configuration.

Figure 5:
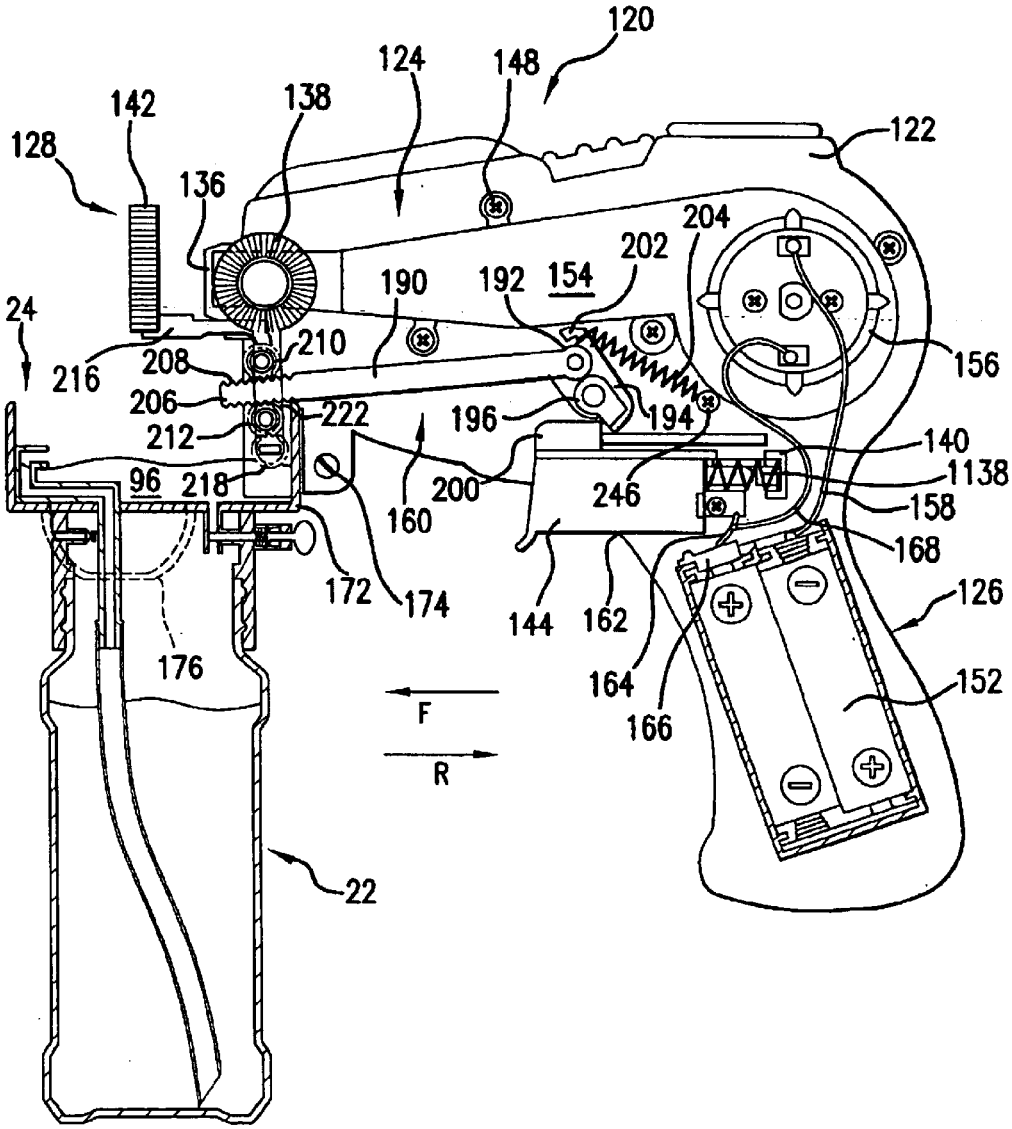
FIG. 5 is a cross-sectional side view of one embodiment of a bubble generating assembly that can incorporate the apparatus of FIG. 1.

The apparatus 20 in FIGS. 1–3 is well-suited for use with virtually any bubble generating device or assembly. The size and shape of the bottom plate 40 and the wall 42 can be adjusted to fit the sizes and shapes of the bubble ring(s) on any bubble generating device or assembly. Although the apparatus 20 is illustrated in FIGS. 1–3 as being used with a stand-alone dipping container 24, it is possible to incorporate the dipping container 24 into any bubble generating device or assembly. As a non-limiting example, FIG. 5 illustrates how the apparatus 20 can be incorporated with the bubble generating assembly that is shown and described in FIGS. 1–6 of U.S. Pat. No. 6,331,130 (Thai), whose entire disclosure is incorporated herein as though set forth fully herein.

Referring to FIG. 5, and to FIGS. 1–6 of U.S. Pat. No. 6,331,130 (Thai), the assembly 120 can be embodied in the form of a bubble producing gun, and has a housing 122 that includes a barrel section 124 and a handle section 126. A bubble producing device 128 and the apparatus 20 are provided at the front end of the barrel section 124 adjacent the nozzles of the barrel section 124. There are three nozzles that are positioned so that two side nozzles (not shown) open to opposing sides of the assembly 120, and one front nozzle 136 opens towards the front of the assembly 120 so that the front nozzle 136 is generally perpendicular to the side nozzles. The bubble producing device 128 has three separate bubble rings that include two side rings 138 and a front ring 142. Each ring 138, 142 is operatively coupled (as described hereinbelow) to the barrel section 124 and can be raised from a rest or non-use position inside the dipping container 24 to a bubble generating position adjacent a corresponding nozzle.

A trigger 144 is operatively coupled to the barrel section 124 and the handle 126 to actuate the assembly 120. A spring 1138 has a rear end that is seated on a shaft of the trigger 144 in a slot 140 in the handle section 126, and has an opposing front end that abuts the rear end of the trigger 144 to naturally bias the trigger 144 in a forward direction (see arrow F) towards the nozzles 136. In particular, when the assembly 120 is a non-use position, the assembly 120 can be actuated by pressing the trigger 144 to simultaneously (1) raise the rings 138, 142 to a bubble generating position and (2) cause air to be blown through the nozzles 136 and through the rings 138, 142 to produce three separate streams of bubbles. This simultaneous action is illustrated in FIG. 5 in the bubble-generating position.

The housing 122 can be provided in the form of two symmetrical outer shells that are connected together by, for example, screws 148 or by welding or glue. These outer shells together define a hollow interior for housing the internal components of the assembly 120, as described below.

The handle section 126 houses a power source 152 which can include two conventional batteries. The barrel 124 houses an air generator or blower 154 that is driven by a motor 156 that is electrically coupled to the power source 152 via a wire 158. The barrel 124 also houses a link assembly 160 that functions to raise and lower the rings 138, 142. The trigger 144 extends through an opening 162 in the housing 122 and is mechanically coupled to the link assembly 160, and electrically coupled to both the power source 152 (by opposing electrical conductors 164 and 166) and the motor 156 (by wiring 168).

The dipping container 24 can have a four-sided configuration that is similar to the solution container shown in U.S. Pat. No. 6,331,130 (Thai), with one side 172 connected to the front of the barrel section 124 by either welding, screws (e.g., 174), or the like. The dipping container 24 can be further modified for use with the bubble generating assembly 120 in FIG. 4 by providing two narrow semi-circular troughs 176 extending from the bottom plate 40 of the dipping container 24. Each trough 176 can be the same as the troughs described in U.S. Pat. No. 6,331,130, and is adapted to receive a portion of a side ring 138 in the non-use position, so that the entire circumference of each side ring 138 can be immersed in the bubble solution 96 that collects inside the troughs 176.

The link assembly 160 operates to mechanically couple the trigger 144 to the rings 138, 142 to control the raising and lowering of the rings 138, 142. The link assembly 160 has a rod 190 having an enlarged and rounded first end 192 that operates as a cam surface. The first end 192 is pivotably coupled to a block 194 (i.e., coupled to allow first end 192 and block 194 to pivot separately). A generally rounded cam piece 196 is permanently coupled to the block 194 (i.e., coupled so that cam piece 196 and block 194 cannot pivot separately). The first end 192 and the cam piece 196 are disposed in a manner in which the circumferential surface of the cam piece 196 rotatably engages the circumferential surface of the first end 192. The cam piece 196 has a straight engaging surface that is adapted to be engaged by a block 200 provided on the trigger 144. The block 194 has a hooked extension 202 on which one end of a spring 204 is coupled. The other end of the spring 204 is secured to the housing 122 (e.g., by screw 246).

The rod 190 has a serrated second end 206 having a plurality of teeth 208 on its top and bottom sides that are adapted to engage a gearing system that operates to raise and lower the rings 138, 142. The gearing system includes gears that are coupled to each of the rings 138, 142. For example, a pair of opposing first and second gears 210 and 212 have teeth that are engaged to travel along the teeth 108 of the opposing top and bottom sides of the rod 190. The gear 210 is housed inside the housing 122, and is connected to one end of a generally L-shaped rod 216 which extends outside the housing 122 and whose opposite end is connected to the front ring 142 in a manner such that the rod 216 is generally perpendicular to the front ring 142. A third gear 218 has teeth that are adapted to engage the teeth of the second gear 212. The third gear 218 is also housed inside the housing 122. The first and second gears 210, 212 can be provided in the form of two toothed wheels, while the third gear 218 can be an elongated circular rod having teeth provided on its outer annular surface. The elongated nature of the third gear 218 allows each of its opposing ends to be connected to one end of a separate rod 222 which extends outside the housing 122 and whose opposite end is connected to one of the side rings 138. Each rod 222 is generally parallel to or co-planar with its corresponding side ring 138. Thus, the third gear 218 alone can be used to control the two side rings 138.

Each ring 138, 142 can have the same structure, and in one non-limiting embodiment, can be a ring-like loop that has an opening, and with ridges or bumps provided on the outer surfaces of the rings. The ridges function to hold the bubble solution against the ring to form a solution film that is blown to form the bubble. The front ring 142 can be larger than the two side rings 138.

The operation of the assembly 120 is described as follows. First, the dipping container 24 is filled with bubble solution 96 using the method described above. At this time, the rings 138, 142 are positioned inside the dipping container 24, and preferably completely inside the bubble solution 96. The side rings 138 are positioned perpendicular to the front ring 142, with the side rings 138 being generally vertical with respect to the orientation of the assembly 120 and partially positioned inside the troughs 176, and with the front ring 142 being generally horizontal with respect to the orientation of the assembly 120 and positioned between the side rings 138.

In the next step, the user presses the trigger 144 to cause the trigger 144 to move rearwardly in the direction of arrow R. The electrical conductor 164 on the trigger 144 will engage the electrical conductor 166 of the power source 152, causing the motor 156 to be powered to generate bursts of air that are then emitted from the blower 154 through the three nozzles. Simultaneously, the block 200 positioned on the top of the trigger 144 engages the straight engaging surface of the cam piece 196, and pushes the cam piece 196 rearwardly in the direction of arrow R. This causes the block 194 and the first end 192 to be pivoted about their pivot point, which in turn causes the lower part of the block 194 (where the cam piece 196 is positioned) to be moved rearwardly, and the upper part of the block 194 (where the first end 192 is positioned) to be moved forwardly in the direction of arrow F. The forward motion of the first end 192 will stretch the spring 204 to build up a spring load, and will cause the entire rod 190 to be moved forwardly, causing the serrated front end 206 to pass between the gears 210 and 212. The teeth 208 on the rod 190 will engage the teeth of the gears 210, 212 and will travel thereon, causing the first gear 210 to rotate in the clockwise direction (as seen in the orientation of FIG. 5), and the second gear 212 to rotate in the counter-clockwise direction, thereby causing the front ring 142 to be raised. The counter-clockwise rotation of the second gear 212 will simultaneously cause the third gear 218 to rotate in a clockwise manner thereby causing the side rings 138 to be raised. Thus, the three rings 138, 142 are raised at about the same time, and when raised, each will be adjacent a nozzle. Therefore, the air that is blown from the blower 154 through the nozzles will pass through the rings 138, 142, producing three separate streams of bubbles.

After the three streams of bubbles have been produced, and upon relaxing the force applied to the trigger 144, two events will occur simultaneously: (1) the spring 1138 coupled to the rear of the trigger 44 will bias the trigger 144 forwardly in the direction of arrow F so as to disengage the contact between the electrical conductors 164 and 166, cutting power to the motor 156, and (2) the built-up spring load of the spring 204 will bias the upper part of the block 194 rearwardly, pulling the rod 190 rearwardly in the direction of arrow R and causing the gears 210, 212, 218 to rotate in directions opposite to those described above (i.e., counter-clockwise for gears 210, 218, and clockwise for gear 212) to lower the wands 138, 142 back into their non-use positions inside the dipping container 24. At this time, the assembly 120 is again ready to produce bubbles upon the pressing of the trigger 144.

Figure 6:
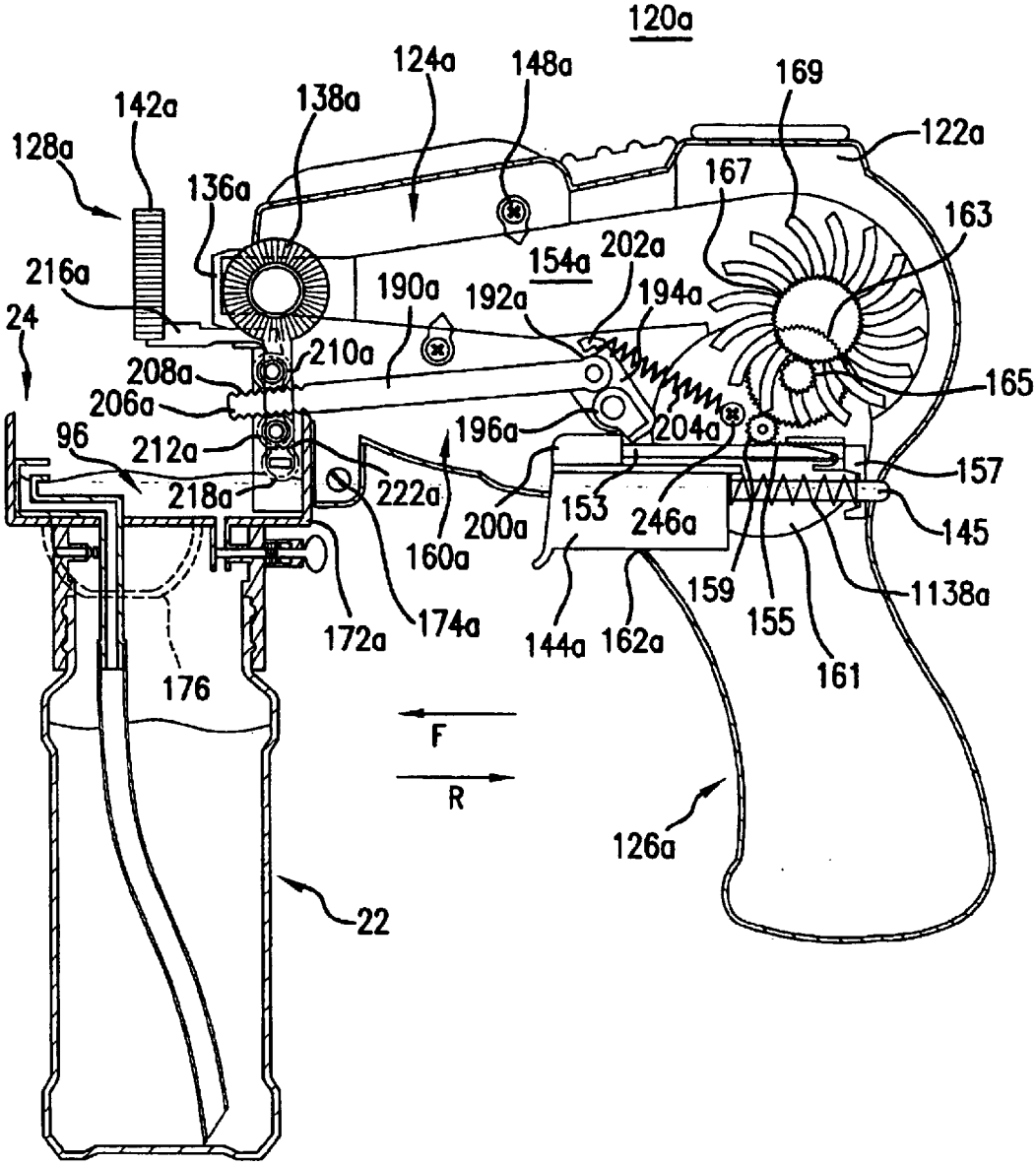
FIG. 6 is a cross-sectional side view of another embodiment of a bubble generating assembly that can incorporate the apparatus of FIG. 1.

FIG. 6 illustrates how the apparatus 20 can be incorporated with another bubble generating assembly 120*a* that is very similar to that illustrated in connection with FIG. 5 above, except that the blower 154*a* in assembly 120*a* is actuated by a manual gear system instead of a battery-operated motor. Therefore, the same numeral designations are used in FIGS. 5 and 6 to designate the same elements except that an "a" has been added to the designations in FIG. 6.

The assembly 120*a* can also be embodied in the form of a bubble producing gun, and has a housing 122*a* that includes a barrel section 124*a* and a handle section 126*a*. A bubble producing device 128*a* and the apparatus 20 are provided at the front end of the barrel section 124*a* adjacent the nozzles 136*a* (which can be the same as the nozzles 136 of the assembly 120 in FIG. 5) of the barrel section 124*a*. The bubble producing device 128*a* has three separate bubble rings that include two side rings 138*a* and a front ring 142*a*. Each ring 138*a*, 142*a* is operatively coupled (as described hereinbelow) to the barrel section 124*a* and can be raised from a rest or non-use position inside the dipping container 24 to a bubble generating position adjacent a corresponding nozzle.

A trigger 144*a* is operatively coupled to the barrel section 124*a* and the handle 126*a* to actuate the assembly 120*a*. A spring 1138*a* has a rear end that is seated on a shaft 145 of the trigger 144*a*, with the shaft 145 secured to the handle section 126*a* via a support 157. The spring 1138*a* has an opposing front end that abuts the rear end of the trigger 144*a* to naturally bias the trigger 144*a* in a forward direction (see arrow F) towards the nozzles 136*a*. In particular, when the assembly 120*a* is a non-use position, the assembly 120*a* can be actuated by pressing the trigger 144*a* to simultaneously (1) raise the rings 138*a*, 142*a* to a bubble generating position and (2) cause air to be blown through the nozzles 136*a* and through the rings 138*a*, 142*a* to produce three separate streams of bubbles. This simultaneous action is illustrated in FIG. 6 which shows the assembly 120*a* in the bubble-generating position.

The housing 122*a* can be provided in the form of two symmetrical outer shells that are connected together by, for example, screws 148*a* or by welding or glue. These outer shells together define a hollow interior for housing the internal components of the assembly 120*a*, as described below.

The barrel 124*a* houses an air generator or blower 154*a* that is driven by a gear system that is operatively coupled to the trigger 144*a*. The barrel 124*a* also houses a link assembly 160*a* that functions to raise and lower the rings 138*a*, 142*a*. The trigger 144*a* extends through an opening 162*a* in the housing 122*a* and is mechanically coupled to the link assembly 160*a*, and operatively coupled to the gear system.

The dipping container 24 can be the same as that illustrated above in connection with assembly 120 in FIG. 5, with one side 172*a* connected to the front of the barrel section 124*a* by either welding, screws (e.g., 174*a*), or the like. The dipping container 24 can also have two narrow semi-circular troughs 176 extending from the bottom plate 40 of the dipping container 24.

The gear system has a toothed shaft 153 having a front end that is secured to the block 200*a* of the trigger 144*a*, and having a plurality of teeth 155 provided along its rear end. The toothed shaft 153 is secured to the housing 122*a* of the barrel 126*a*. The teeth 155 on the toothed shaft 153 are adapted to engage the teeth on a first gear 159 that carries a rotating wheel 161. The teeth of the first gear 159 are also adapted to engage the teeth on a second gear 163. The second gear 163 carries a toothed wheel 165 operating as a third gear, and the teeth on the third gear 165 are adapted to engage the teeth on a fourth gear 167. The fourth gear 167 carries a plurality of blades 169. Thus, when the trigger 144*a* is pushed in a rearward direction (see the arrow R), the toothed shaft 153 causes the first gear 159 to rotate, which in turn causes the second gear 163 to rotate, which in turn causes the third gear 165 to rotate, which in turn causes the fourth gear 167 to rotate. Rotation of the fourth gear 167 will rotate the blades 169 in a counter-clockwise direction (as viewed from the orientation of FIG. 6), thereby generating a stream of air that is carried along the blower 154*a* to the nozzles 136*a*.

The link assembly 160*a* operates to mechanically couple the trigger 144*a* to the rings 138*a*, 142*a* to control the raising and lowering of the rings 138*a*, 142*a*. The link assembly 160*a* has a rod 190*a* having an enlarged and rounded first end 192*a* that operates as a cam surface. The first end 192*a* is pivotably coupled to a block 194*a* (i.e., coupled to allow first end 192*a* and block 194*a* to pivot separately with respect to each other). A generally rounded cam piece 196*a* is permanently coupled to the block 194*a* (i.e., coupled so that cam piece 196*a* and block 194*a* cannot pivot separately with respect to each other). The first end 192*a* and the cam piece 196*a* are disposed in a manner in which the circumferential surface of the cam piece 196*a* rotatably engages the circumferential surface of the first end 192*a*. The cam piece 196*a* has a straight engaging surface that is adapted to be engaged by the block 200*a* provided on the trigger 144*a*. The block 194*a* has a hooked extension 202*a* on which one end of a spring 204*a* is coupled. The other end of the spring 204*a* is secured to the wheel 161 (e.g., by screw 246*a*).

The rod 190*a* has a serrated second end 206*a* having a plurality of teeth 208*a* on its top and bottom sides that are adapted to engage a gearing system that operates to raise and lower the rings 138*a*, 142*a*. The gearing system is the same as the gearing system illustrated in assembly 120 in FIG. 5, and includes the first and second gears 210*a* and 212*a* that have teeth that are engaged to travel along the teeth 208*a* on the opposing top and bottom sides of the rod 190*a*. The gear 210*a* is housed inside the housing 122*a*, and is connected to one end of a generally L-shaped rod 216*a* which extends outside the housing 122*a* and whose opposite end is connected to the front ring 142*a* in a manner such that the rod 216*a* is generally perpendicular to the front ring 142*a*. An elongated third gear 218*a* (that is housed inside the housing 122*a*) has teeth that are adapted to engage the teeth of the second gear 212*a*. The elongated nature of the third gear 218*a* allows each of its opposing ends to be connected to one end of a separate rod 222*a* which extends outside the housing 122*a* and whose opposite end is connected to one of the side rings 138*a*. Each rod 222*a* is generally parallel to or co-planar with its corresponding side ring 138*a*. Thus, the third gear 218*a* alone is used to control the two side rings 138*a*. Each ring 138*a*, 142*a* can have the same structure as the rings 138 and 142 described above.

The operation of the assembly 120*a* is described as follows. First, the dipping container 24 is filled with bubble solution 96 using the method described above. At this time, the rings 138*a*, 142*a* are positioned inside the dipping container 24, and preferably completely inside the bubble solution 96. The side rings 138*a* are positioned perpendicular to the front ring 142*a*, with the side rings 138*a* being generally vertical with respect to the orientation of the assembly 120*a* and partially positioned inside the troughs 176, and with the front ring 142*a* being generally horizontal with respect to the orientation of the assembly 120*a* and positioned between the side rings 138*a*.

In the next step, the user presses the trigger 144*a* to cause the trigger 144*a* to move rearwardly in the direction of the arrow R. The toothed shaft 153 will cause the gear system to rotate the blades 169 in the manner described above, so as to generate bursts of air that are then emitted from the blower 154*a* through the three nozzles. Simultaneously, the block 200*a* positioned on the top of the trigger 144*a* engages the straight engaging surface of the cam piece 196*a* (as shown in FIG. 6), and pushes the cam piece 196*a* rearwardly in the direction of arrow R. This causes the block 194*a* and the first end 192*a* to be pivoted about their pivot point, which in turn causes the lower part of the block 194*a* (where the cam piece 196*a* is positioned) to be moved rearwardly in the direction of the arrow R, and the upper part of the block 194*a* (where the first end 192*a* is positioned) to be moved forwardly in the direction of arrow F. The forward motion of the first end 192*a* will stretch the spring 204*a* to build up a spring load, and will cause the entire rod 190*a* to be moved forwardly, causing the serrated front end 206*a* to pass between the gears 210*a* and 212*a*. The teeth 208*a* on the rod 190*a* will engage the teeth of the gears 210*a*, 212*a* and will travel thereon, causing the first gear 210*a* to rotate in the clockwise direction (as seen in the orientation of FIG. 6), and the second gear 212*a* to rotate in the counter-clockwise direction. Rotation of the first gear 210*a* in the clockwise direction causes the front ring 142*a* to be raised. The counter-clockwise rotation of the second gear 212*a* will simultaneously cause the third gear 218*a* to rotate in a clockwise manner thereby causing the side rings 138*a* to be raised. Thus, the three rings 138*a*, 142*a* are raised at about the same time, and when raised, each will be adjacent a corresponding nozzle. Therefore, the air that is blown from the blower 154*a* through the nozzles will pass through the rings 138*a*, 142*a*, producing three separate streams of bubbles.

After the three streams of bubbles have been produced, and upon relaxing the force applied to the trigger 144*a*, two events will occur simultaneously: (1) the spring 1138*a* coupled to the rear of the trigger 44*a* will bias the trigger 144*a* forwardly in the direction of arrow F so as to cause the toothed shaft 153 to move forwardly, causing the gears 159, 163, 165, 167 to rotate in directions that are opposite to the directions of rotation experienced by these gears 159, 163, 165, 167 when the trigger 144*a* is pressed, which in turn causes the blades 169 to rotate in the clockwise direction (as viewed from the orientation in FIG. 6), thereby stopping the flow of air from the blower 154*a*, and (2) the built-up spring load of the spring 204*a* will bias the upper part of the block 194*a* rearwardly, pulling the rod 190*a* rearwardly in the direction of arrow R and causing the gears 210*a*, 212*a*, 218*a* to rotate in directions opposite to those described above (i.e., counter-clockwise for gears 210*a*, 218*a*, and clockwise for gear 212*a*) to lower the wands 138*a*, 142*a* back into their non-use positions inside the dipping container 24. At this time, the assembly 120*a* is again ready to produce bubbles upon the pressing of the trigger 144*a*.

The bubble solution 96 in the dipping chamber 44 can be filled and replenished by squeezing the bubble solution bottle 22, in the same manner described above in connection with FIGS. 1–4. The remaining bubble solution in the dipping chamber 44 can be drained back into the bubble solution bottle 22 via the opening 50 and the feedback channel 52.

Figure 7:
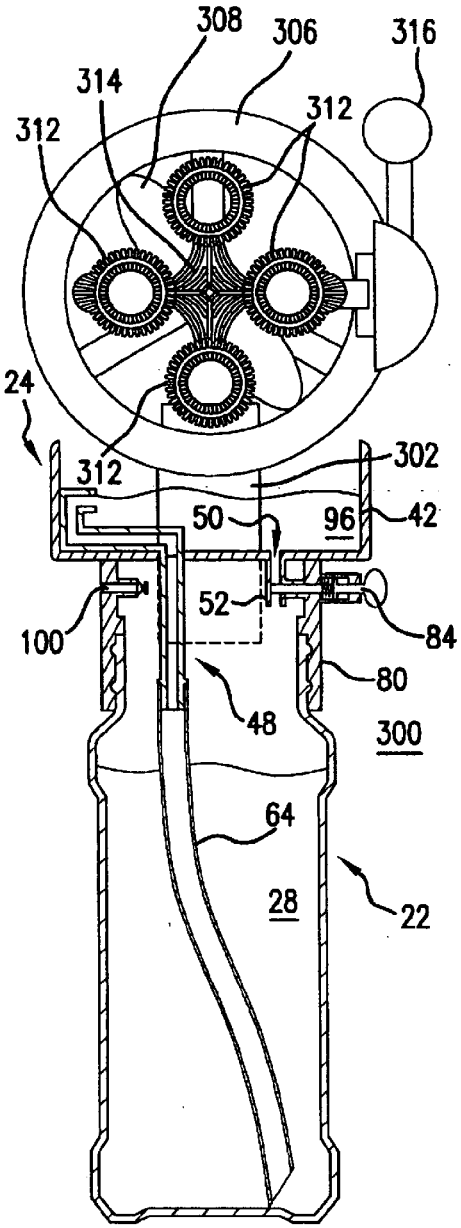
FIG. 7 is a cross-sectional front view of another embodiment of a bubble generating assembly that can incorporate the apparatus of FIG. 1.
Figure 8:
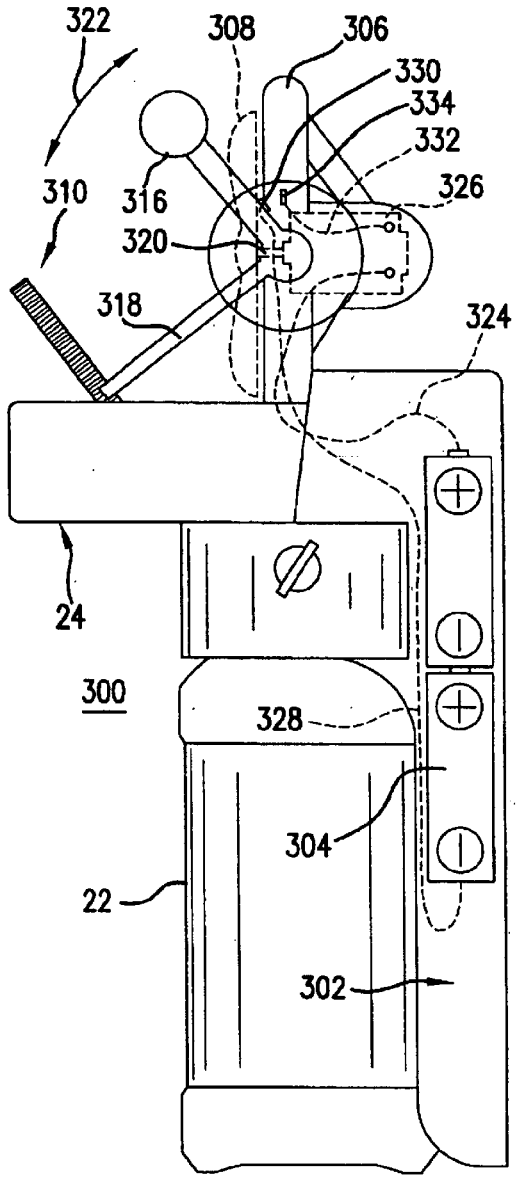
FIG. 8 is a cross-sectional side plan view of the assembly of FIG. 7.

FIGS. 7 and 8 illustrate how the apparatus 20 can be incorporated with yet another bubble generating assembly 300. The assembly 300 has a generally elongated vertical housing 302 that retains a power source 304 (which can be one or more batteries). The housing 302 can be provided in the form of two symmetrical outer shells that are connected together by, for example, screws, welding or glue. These outer shells together define a hollow interior for housing the internal components of the assembly 300, as described below. The dipping container 24 can be the same as that illustrated above in connection with FIGS. 1–4, and has one side that can be connected (e.g., by welding) to the top of the housing 302 in a manner such that the bubble solution bottle 22 is positioned side-by-side and parallel with the vertical housing 302. Alternatively, the dipping container 24 can be formed in one piece with (i.e., as part on the top of the housing 302. A fan support 306 extends vertically from the top of the housing 302, and has a fan 308 positioned on its front side to blow air in a horizontal direction.

A bubble producing device 310 has a plurality (e.g., four) of separate bubble rings 312 that are interconnected to each other by a webbing 314. The bubble producing device 310 is connected to a handle bar 316 via a rod 318 that spaces the rings 312 from the fan 308. The connection location 320 between the rod 318 and the handle bar 316 is pivotally coupled to a part of the fan support 306. Thus, the handle bar 316 can be lifted or lowered (see arrows 322) to pivot the bubble producing device 310 between a rest or non-use position inside the dipping container 24 and a bubble generating position that is horizontally aligned with the fan 308.

A first wire 324 is electrically coupled between the power source 304 and a motor 326 that is housed inside the fan support 306. A second wire 328 is electrically coupled between the power source 304 and a contact 330 provided on a rear surface of the handle bar 316. A third wire 332 is electrically coupled between the motor 326 and a contact 334 provided on a front surface of the fan support 306.

In operation, the handle bar 316 is normally lowered to pivot the bubble producing device 310 into a rest or non-use position inside the dipping container 24. In this non-use position, the contacts 330 and 334 are separated from each other so that the electrical circuit is opened. When the user desires to create bubbles, the user pivots the handle bar 316 upwardly (in a clockwise direction as viewed from the orientation of FIG. 8) so that the contacts 330 and 334 engage each other. The engagement of the contacts 330 and 334 closes the electrical circuit, so that the power source 304 provides power to drive the motor 326, which actuates the fan 308 to generate a stream of air. In addition, when the user pivots the handle bar 316 upwardly, the bubble rings 312 are brought up to a generally vertical orientation where the bubble rings 312 are generally parallel with the fan 308. Each bubble ring 312 will have a film of bubble solution spread about it as a result of the bubble rings 312 being normally immersed in the bubble solution 96 when in the non-use position. The stream of air from the fan 308 is blown horizontally towards the bubble rings 312 to generate a plurality of bubbles.

The bubble solution 96 in the dipping chamber 44 can be filled and replenished by squeezing the bubble solution bottle 22, in the same manner described above in connection with FIGS. 1–4. The remaining bubble solution in the dipping chamber 44 can be drained back into the bubble solution bottle 22 via the opening 50 and the feedback channel 52.

When the user pivots the handle bar 316 downwardly (in a counter-clockwise direction as viewed from the orientation of FIG. 8), the contacts 330 and 334 disengage from each other, opening the electrical circuit so that the fan 308 stops generating a stream of air. At the same time, the downward pivot of the handle bar 316 will bring the bubble producing device 310 back to the rest or non-use-position inside the dipping container 24.

Figure 9:
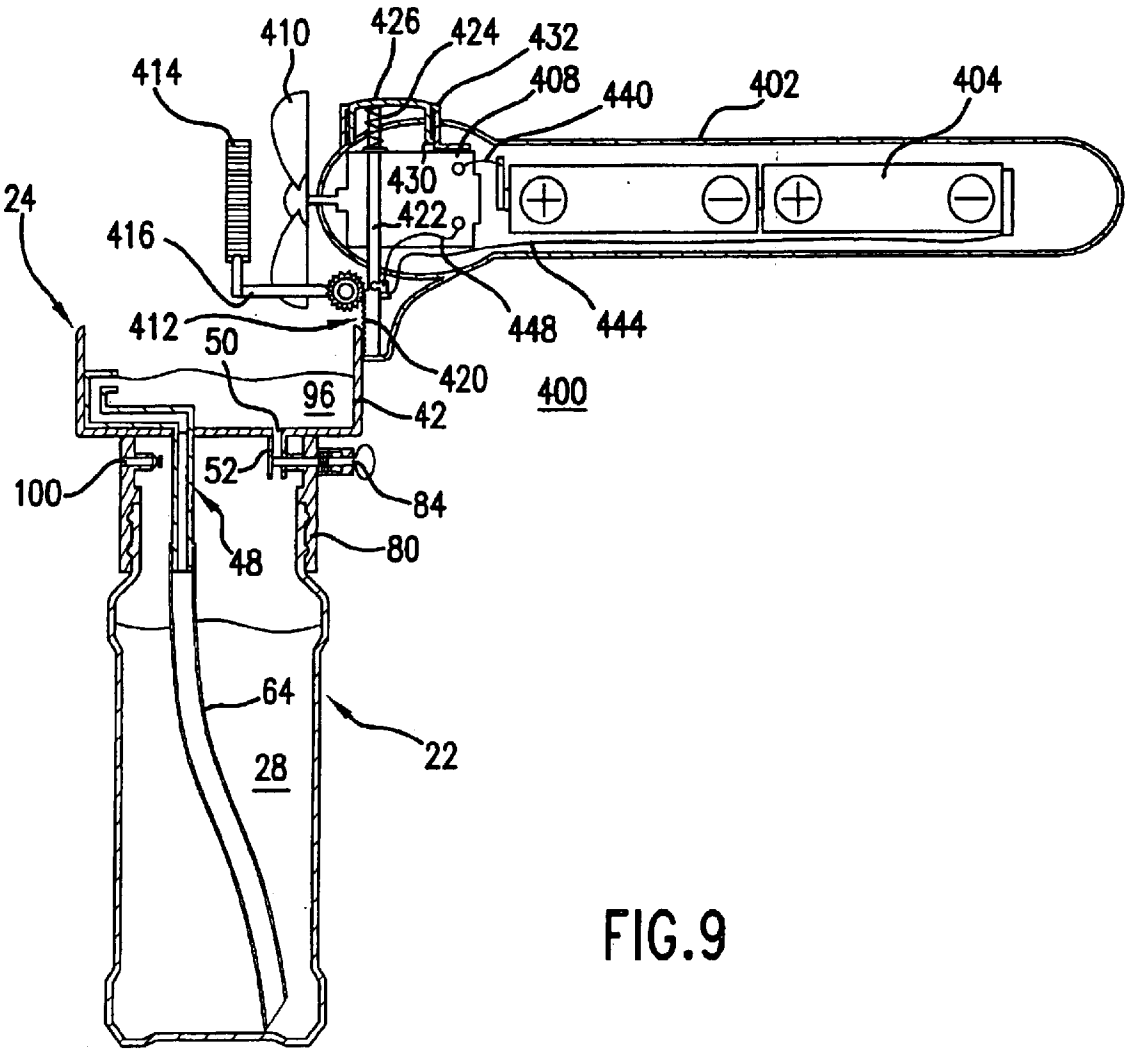
FIG. 9 is a cross-sectional side view of yet another embodiment of a bubble generating assembly that can incorporate the apparatus of FIG. 1, shown in the bubble generating position.
Figure 10:
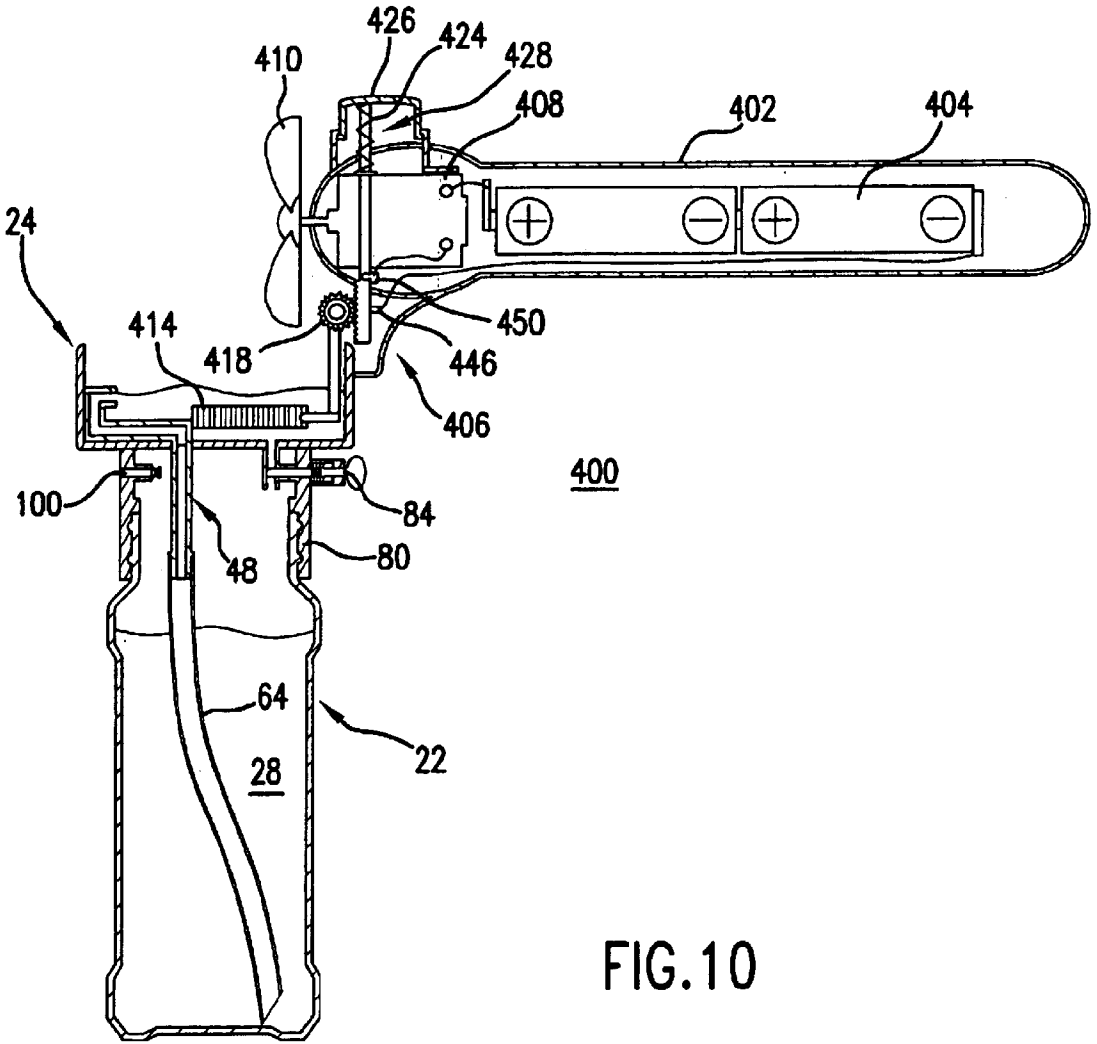
FIG. 10 is a cross-sectional side view of the assembly of FIG. 9 shown in the non-use position.

FIGS. 9 and 10 illustrate how the apparatus 20 can be incorporated with yet another bubble generating assembly 400. The assembly 400 has a generally elongated horizontal housing 402 that retains a power source 404 (which can be one or more batteries). The housing 402 can be provided in the form of two symmetrical outer shells that are connected together by, for example, screws, welding or glue. These outer shells together define a hollow interior for housing the internal components of the assembly 400, as described below. The dipping container 24 can be the same as that illustrated above in connection with FIGS. 1–4, and has one side that can be connected (e.g., by welding) to a forward end 406 of the housing 402 in a manner such that the bubble solution bottle 22 is positioned generally perpendicular to the horizontal housing 402. Alternatively, the dipping container 24 can be formed as part of the housing 402. A motor 408 is provided inside the forward end 406 of the housing 402. A fan 410 is carried on the motor 408 and extends through a forward opening 412 of the housing 402 to outside the forward end 406 of the housing 402.

The assembly 400 has a bubble producing device that has one bubble ring 414. Although one bubble ring 414 is shown, it is possible to provide a plurality of bubble rings 414 using any of the principles illustrated herein. An L-shaped bar 416 connects the bubble ring 414 to a toothed wheel 418. The teeth on the wheel 418 extends through the opening 42 to engage the teeth 420 on the lower end of a vertical drive shaft 422. The drive shaft 422 is retained inside the housing 402, and has an upper end that receives a biasing element 424 (e.g., a spring). A switch button 426 is provided in a side opening 428 of the housing 402, with the bottom of the switch button 426 contacting the biasing element 424. The biasing element 424 normally biases the switch button 426 in a direction away from the housing 402. The switch button 426 has a flanged edge 430 that is retained inside the side opening 428 and engages a flanged edge 432 of the opening 428 to ensure that the switch button 426 cannot be removed from the opening 428.

A first wire 440 is electrically coupled between the power source 404 and the motor 408. A second wire 444 is electrically coupled between the power source 404 and a first contact 446. A third wire 448 is electrically coupled between the motor 408 and a second contact 450 provided on the drive shaft 422.

In operation, the switch button 426 and the drive shaft 422 cooperate to raise and lower the bubble ring 414 from the dipping container 24. When the bubble ring 414 is in a rest or non-use position inside the dipping container 24, as shown in FIG. 10, the biasing element 424 normally biases the switch button 426 away from the housing 402. When the user presses on the switch button 426, the pressing force overcomes the normal bias of the biasing element 424, and pushes the drive shaft 422 vertically down. As the drive shaft 422 moves down, the teeth 420 on the drive shaft 422 will engage the teeth on the toothed wheel 418, causing the toothed wheel 418 to rotate in a clockwise direction (when viewed in the orientation of FIGS. 9 and 10) to raise the bubble ring 414 from the dipping container 24 to a bubble generating position shown in FIG. 9, where the bubble ring 414 is brought up to a generally vertical orientation where it is generally parallel with (and spaced apart from) the fan 410. At the same time, the downward vertical movement of the drive shaft 422 will eventually cause the second contact 450 to engage the first contact 446, closing the electrical circuit so that the power source 404 provides power to drive the motor 408, which actuates the fan 410 to blow a stream of air. The bubble ring 414 will have a film of bubble solution spread about it as a result of it being normally immersed in the bubble solution 96 when in the non-use position. Thus, the fan 410 will blow a stream of air towards the bubble ring 414 to generate bubbles from the bubble ring 414. As long as the user continues to press on the switch button 426, the bubble ring 414 will stay in the orientation shown in FIG. 9 and the fan 410 will continue to blow a stream of air.

However, once the user releases the switch button 426, the normal bias of the biasing element 424 will push the switch button 426 apart from the drive shaft 422, so that the switch button 426 moves back up. At this time, the force of gravity acting on the bubble ring 414 and the L-shaped bar 416 will bias the bubble ring 414 downwardly towards the dipping container 24, thereby causing the toothed wheel 418 to rotate in a counter-clockwise direction (when viewed in the orientation of FIGS. 9 and 10). The counter-clockwise rotation of the toothed wheel 418 will move the drive shaft 422 upwardly (because of the toothed engagement between the drive shaft 422 and the toothed wheel 418), causing the contacts 446 and 450 to disengage from each other, thereby opening the electrical circuit so that the fan 410 stops blowing. Gravity will eventually bring the bubble ring 414 back to the rest or non-use position inside the dipping container 24, as shown in FIG. 10.

The bubble solution 96 in the dipping chamber 44 can be filled and replenished by squeezing the bubble solution bottle 22, in the same manner described above in connection with FIGS. 1–4. The remaining bubble solution in the dipping chamber 44 can be drained back into the bubble solution bottle 22 via the opening 50 and the feedback channel 52.

FIGS. 11–14 illustrate how the apparatus 20 can be modified to be incorporated with yet another bubble generating assembly 500. The assembly 500 differs from the other assemblies 120, 120*a*, 300 and 400 described above in that the assembly 500 uses a dipping container 24*x* that has a different shape from the dipping container 24 described above so that the entire assembly 500 can be supported above the cylindrical connector 76 that is provided on the bottom plate 40. In particular, the cylindrical connector 76 (and its components 80, 82,100, 102, 50, 52, 90, 92, 84, 94) in the assembly 500 are the same as the same corresponding components in FIGS. 1–4 above. The tube 64*x* in the assembly 500 is similar to the tube 64 in FIGS. 1–4 above, except that it now extends from the interior 28 of the bubble solution bottle 22 through a holder 502 that is secured in the opening 46 (not shown in FIGS. 11–14 because it is filled up by the holder 502) in the bottom plate 40 and into the dipping chamber 44*x*, terminating at an upper end 65*x* which has an outlet through which bubble solution can exit the tube 64*x* into the dipping chamber 44*x*.

The assembly 500 has a generally circular housing 504 that has two flat circular side walls 506 connected by a circular connecting wall 508. The cylindrical connector 76 is provided at and extends from the bottom point 510 of the connecting wall 508 (see FIG. 14) so that the connecting wall 508 is actually supported on a portion of the bottom plate 40. The dipping container 24*x* is formed by providing an enclosing wall 25*x* that extends from both the top of the bottom plate 40 and from the connecting wall 508, with the enclosing wall 25*x* defining a curved and pouch-like dipping chamber 44*x* that corresponds in configuration with the curvature of the connecting wall 508. A curved shielding wall 512 extends vertically downwardly from the connecting wall 508 (at a location opposite from the enclosing wall 25*x*) to be parallel and adjacent to the bubble solution bottle 22.

Figure 11:
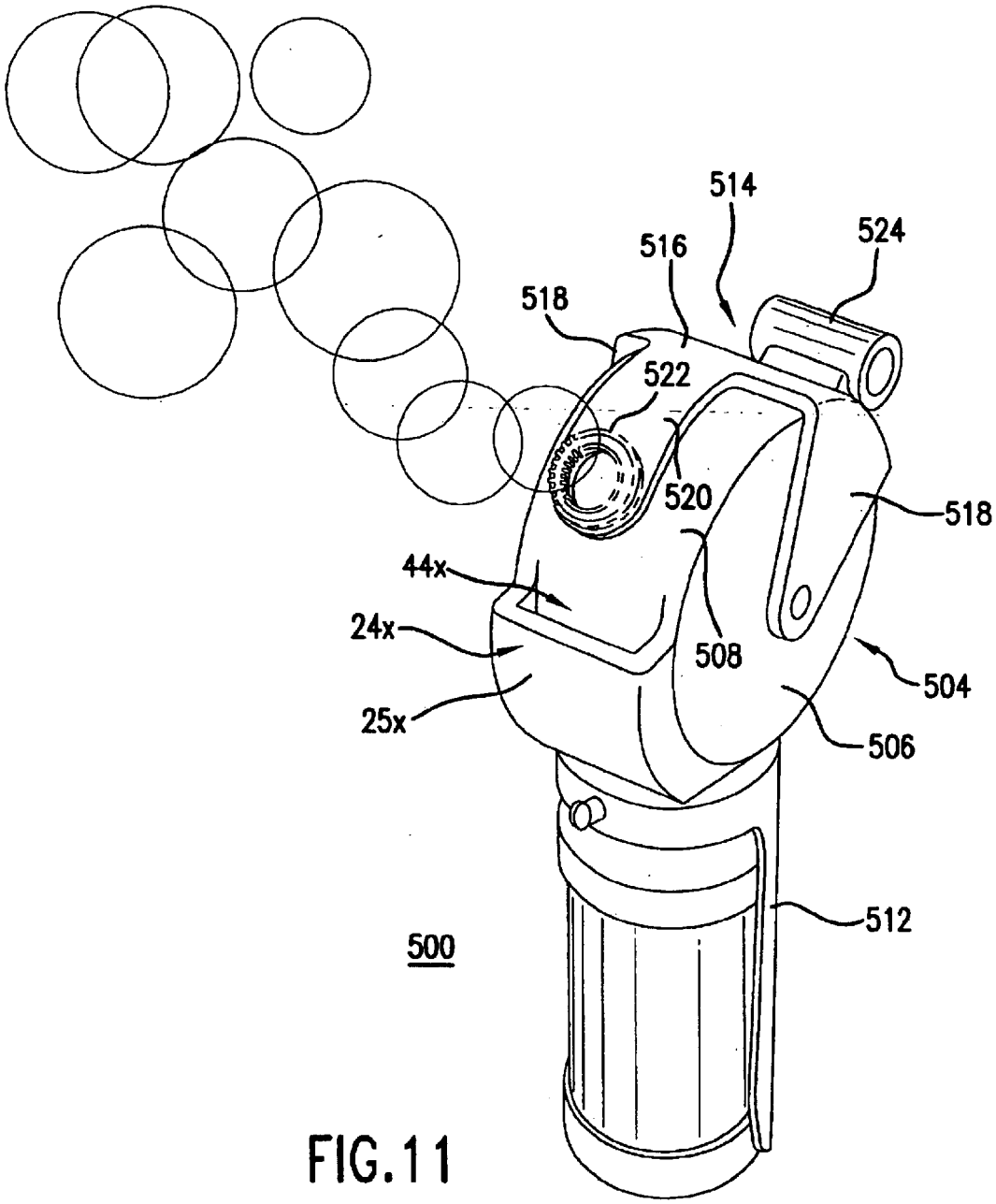
FIG. 11 is a perspective view of yet another embodiment of a bubble generating assembly that can incorporate the apparatus of FIG. 1.

As best shown in FIG. 11, a lever assembly 514 is provided for pivoting movement at the top of the connecting wall 508. The lever assembly 514 includes a curved plate 516 that has the same curvature as the connecting wall 508 and which is adapted to slide in reciprocating manner over the outer surface of the connecting wall 508. A pair of side arms 518 are provided, and each side arm 518 extends in a perpendicular manner from each side of the curved plate 516 along the outer surface of each side wall 506 to a pivot location at about the center of the corresponding circular side walls 506. A curved bubble producing plate 520 extends from the curved plate 516 in a manner such that the bubble producing plate 520 also has the same curvature as the connecting wall 508 and is adapted to slide in reciprocating manner over the outer surface of the connecting wall 508. In one embodiment, the curved plate 516, the side arms 518 and the bubble producing plate 520 can be provided in one piece. A bubble ring 522 can be provided on the bubble producing plate 520. The bubble ring 522 can be provided as an opening in the bubble producing plate 520 with ridges (which can be the same as the ridges described above) provided along the periphery of the opening. A handle grip 524 extends radially outwardly from the curved plate 516.

A power source 530, a motor 532, a gear system, and a blower 534 are all housed inside the housing 504. The power source 530, the motor 532 and the gear system are provided on one side of the housing 504 (see FIG. 12), and the blower 534 is provided on the other side of the housing 504 (see FIGS. 13 and 14). The power source 530 can comprise one or more batteries, and is electrically coupled by a first wire 536 to the motor 532. A second wire 552 electrically couples the power source 530 to a first contact 554, and a third wire 556 electrically couples the motor 532 to a second contact 558 that is provided adjacent a rear edge 560 of one side wall 518.

The motor 532 carries a rotating shaft 538 that carries a first crown gear 540. The gear system includes the first gear 540, a second gear 542, a third gear 544, and a fourth gear 546. The second gear 542 has lateral teeth that are adapted to engage the circumferential teeth of the first gear 540. The second gear 542 also has circumferential teeth that are adapted to engage the circumferential teeth of the third gear 544. Similarly, the third gear 544 has circumferential teeth that are adapted to engage the circumferential teeth of the fourth gear 546. The fourth gear 546 is positioned at the center of the housing 504 along a center line that connects the center of the side walls 506. A shaft 548 extends along this center line, and extends, through the side arms 518, and the center of the side walls 506, the center of the fourth gear 546, and a blower support plate 550. The blower support plate 550 carries the blower 534 on one side thereof, and the blower support plate 550 is adjacent the fourth gear 546 on the other side thereof. Thus, the shaft 548 couples the fourth gear 546 and the blower 534 for simultaneous rotation.

Figure 12:
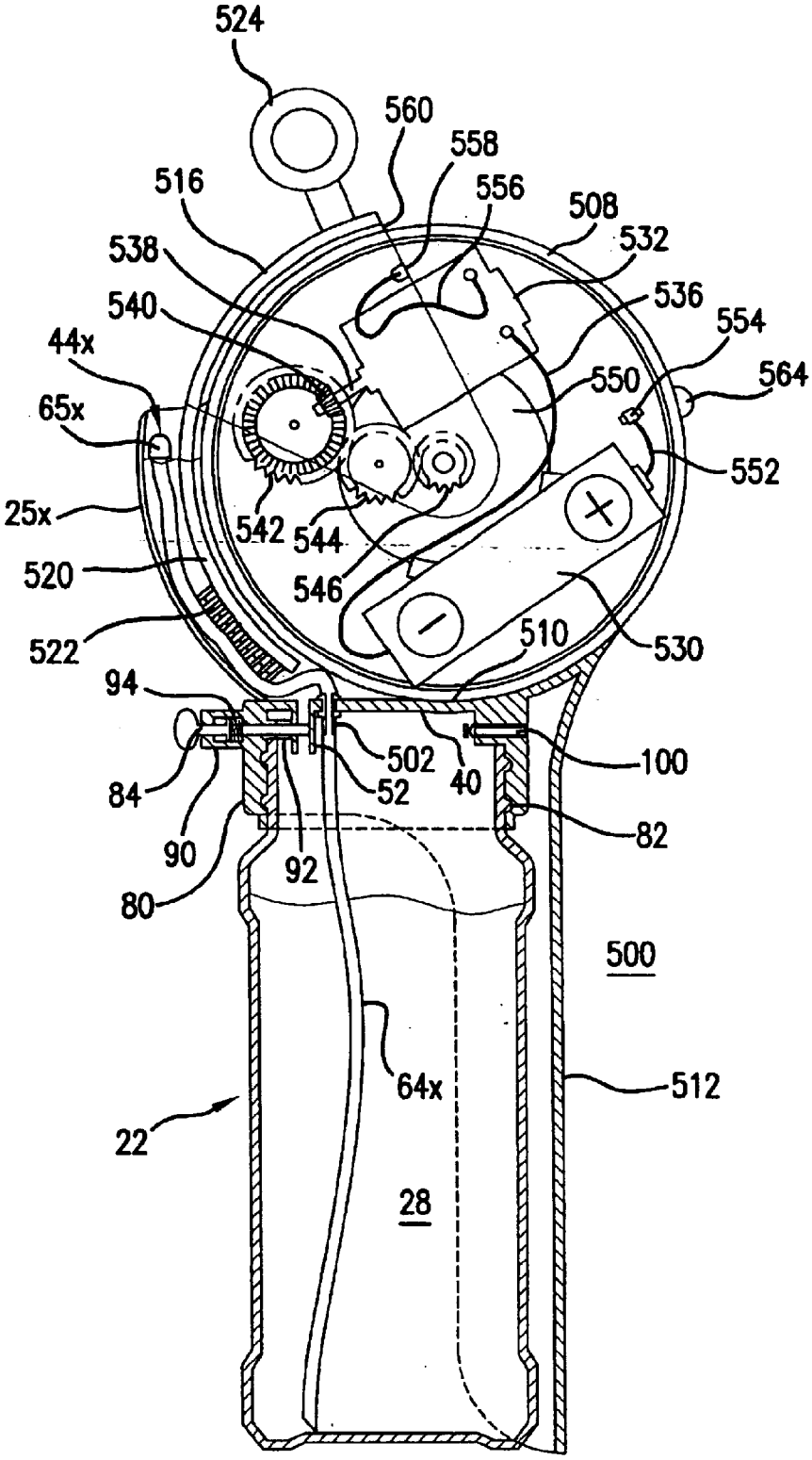
FIG. 12 is a cross-sectional view of one side of the assembly of FIG. 11.
Figure 13:
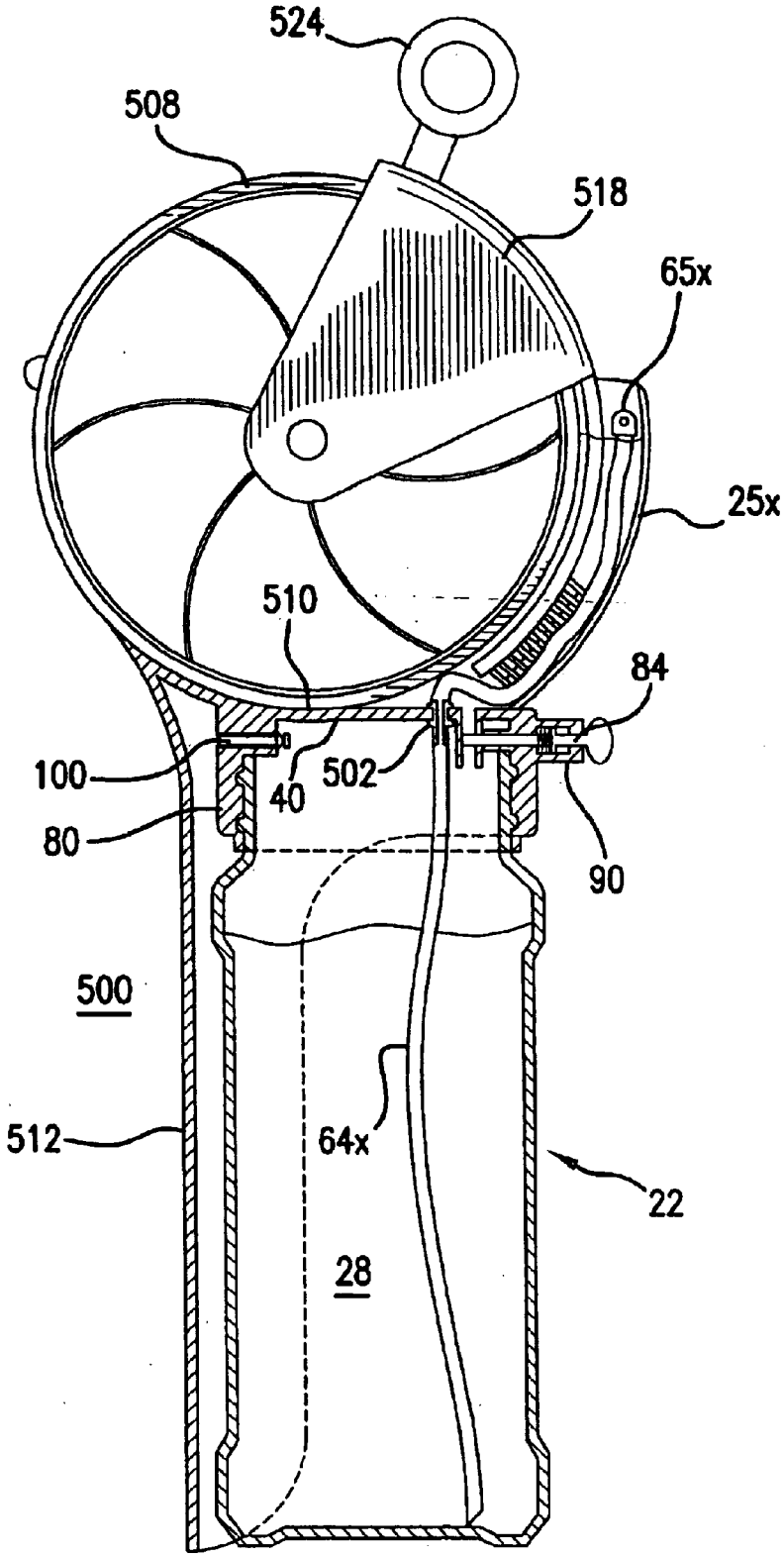
FIG. 13 is a cross-sectional view of another side of the assembly of FIG. 11 shown in the non-use position.
Figure 14:
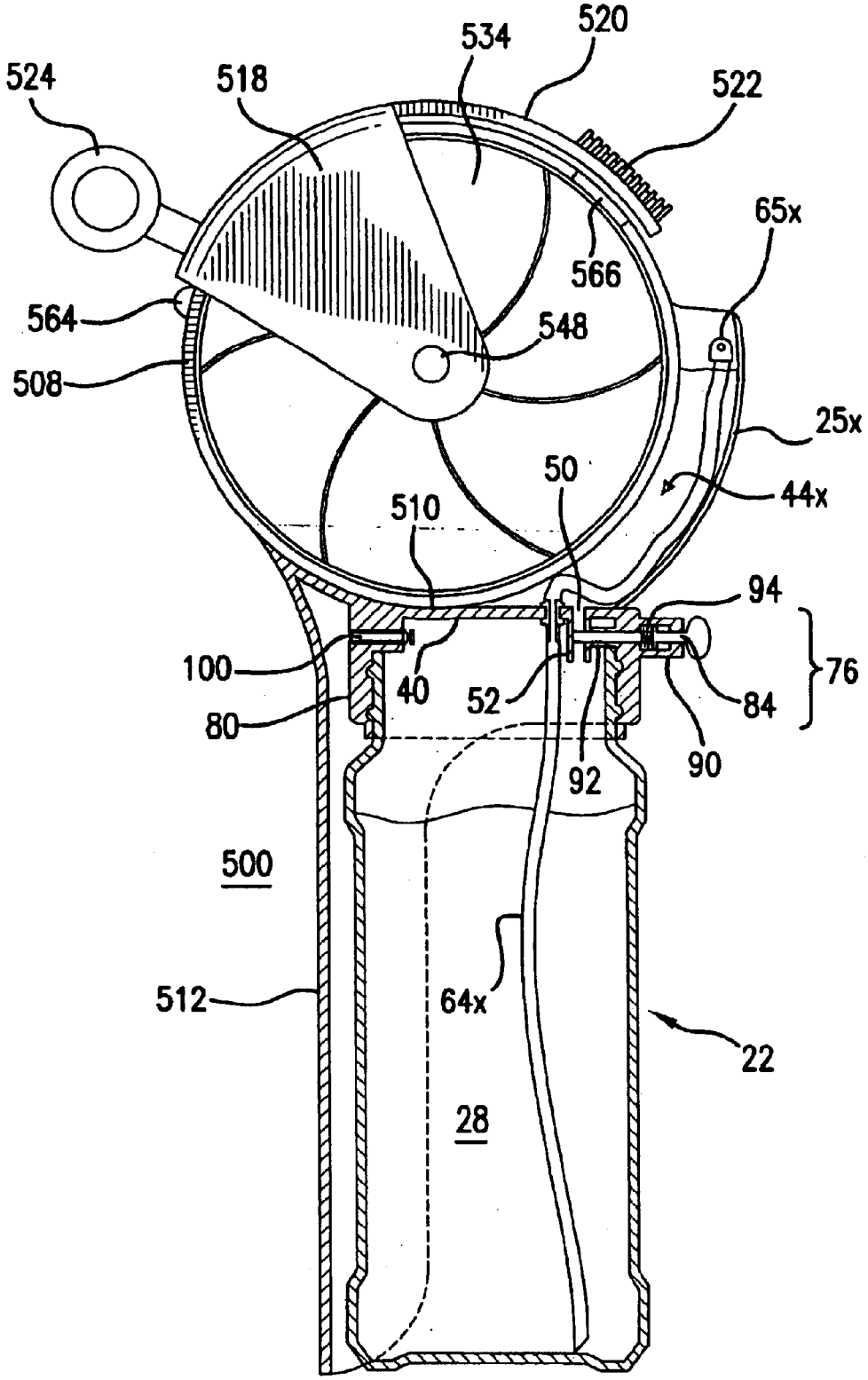
FIG. 14 is a cross-sectional view of the assembly of FIG. 13 shown in the bubble generating position.

In operation, the lever assembly 514 is normally pivoted forwardly (in a counter-clockwise direction as viewed from the orientation of FIG. 12) so that the bubble ring 522 is lowered into a rest or non-use position inside the dipping chamber 44*x*, as shown in FIGS. 12 and 13. In this non-use position, the contacts 554 and 558 are separated from each other so that the electrical circuit is opened. When the user desires to create bubbles, the user grips the handle grip 524 and pivots the handle grip 524 and the rest of the lever assembly 514 rearwardly (in a clockwise direction as viewed from the orientation of FIG. 12) so that the bubble ring 522 is raised from the dipping chamber 44*x*. When the lever assembly 514 is pivoted to its rearmost position (where the rear edge 560 of one of the side walls 518 abuts against a stop member 564 provided on the connecting wall 508), as shown in FIG. 14, the contacts 554 and 558, will engage each other. The engagement of the contacts 554 and 558 closes the electrical circuit, so that the power source 530 provides power to drive the motor 532, which rotates the shaft 538. The rotation of the shaft 538 is translated to the fourth gear 546 via the rotational engagements of the teeth of the gears 540, 542 and 544 that was described above, so that the fourth gear 546 rotates. The rotation of the fourth gear 546 causes rotation of the shaft 548 and the blower support plate 550 and the blower 534 carried thereon, which results in the generation of a stream of air that is directed through an opening 566 (see FIG. 14) in the connecting wall 508. This opening 566 is aligned with the bubble ring 522 when the lever assembly 514 has been pivoted to its rearmost position. In addition, when the bubble ring 522 is brought up to be aligned with the opening 566, the bubble ring 522 will have a film of bubble solution spread about it as a result of the bubble ring 522 being normally immersed in the bubble solution in the dipping chamber 44*x* when in the non-use position. The stream of air from the blower 534 is directed through the opening 566 towards the aligned bubble ring 522 to generate bubbles. FIG. 14 shows the assembly 500 in the bubble generating position.

When the user pivots the lever assembly 514 forwardly again, the contacts 554 and 558 disengage from each other, opening the electrical circuit so that the motor 532 is stopped, thereby stopping rotation of the gear system, and the blower 534 stops blowing. At the same time, the forward pivot of the lever assembly 514 will bring the bubble ring 522 back to the rest or non-use position inside-the dipping chamber 44*x*, as shown in FIGS. 12 and 13.

The bubble solution in the dipping chamber 44*x* can be filled and replenished by squeezing the bubble solution bottle 22, in the same manner described above in connection with FIGS. 1–4. In this regard, the bubble solution is drawn through the tube 64*x* and exits the outlet at the upper end 65*x* of the tube 64*x* into the dipping chamber 44*x*. The remaining bubble solution in the dipping chamber 44*x* can be drained back into the bubble solution bottle 22 via the opening 50 and the feedback channel 52.

Figure 15:
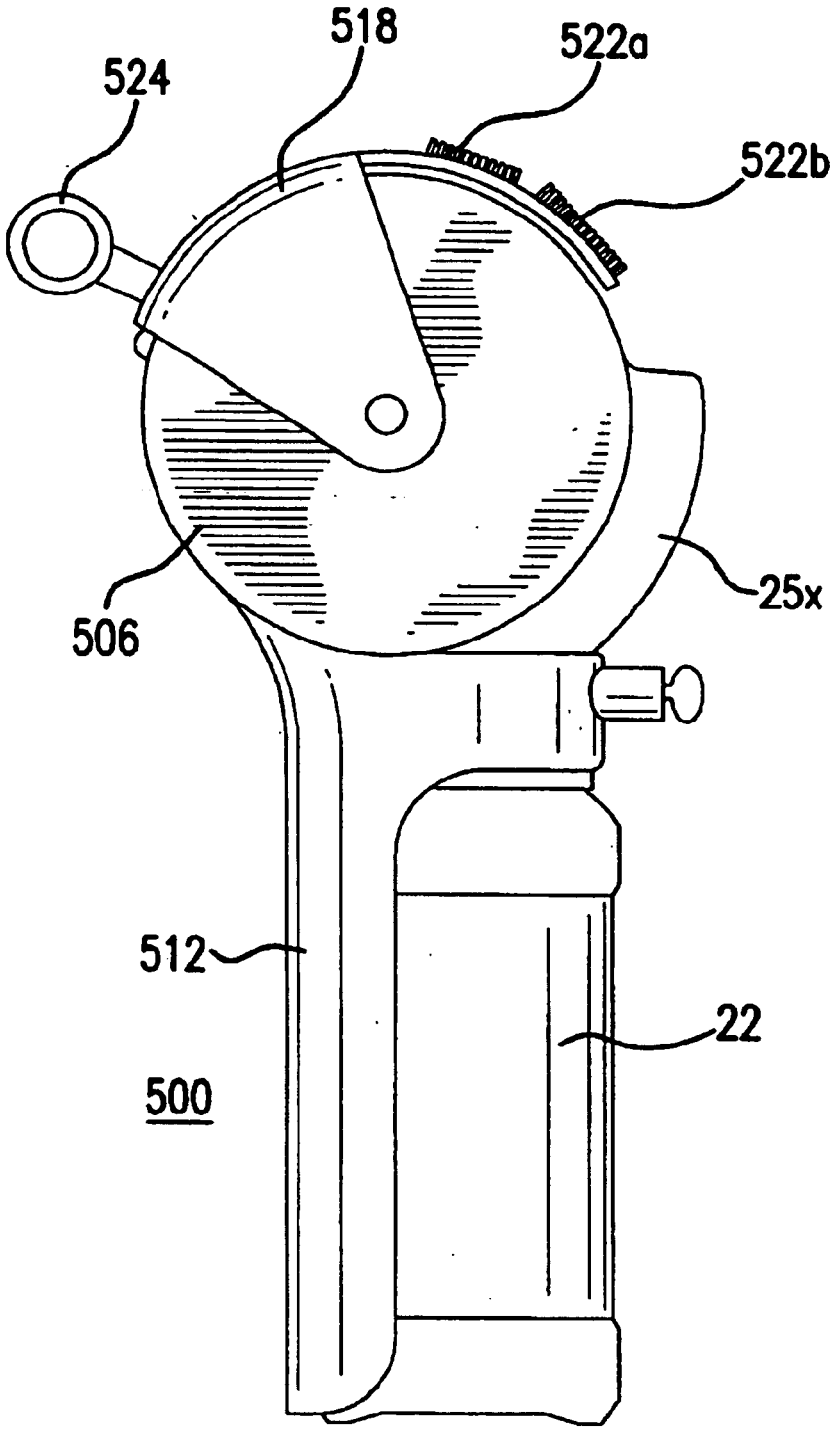
FIG. 15 is a side plan view illustrating a modification that can be made to the assembly of FIGS. 11–14.

Although FIGS. 11–14 illustrate the assembly 500 and its lever assembly 514 as carrying one bubble ring 522, it is possible to provide two or more bubble rings 522*a*, 522*b*, as illustrated in the side plan view of FIG. 15. The only modification that would be needed is that the opening 566 would need to be enlarged so that the air from the blower 534 can be directed at both bubble rings 522*a*, 522*b*, or an additional aligned opening similar to opening 566 would need to be provided so that the air from the blower 534 can be directed at both bubble rings 522*a*, 522*b*.

Figure 16:
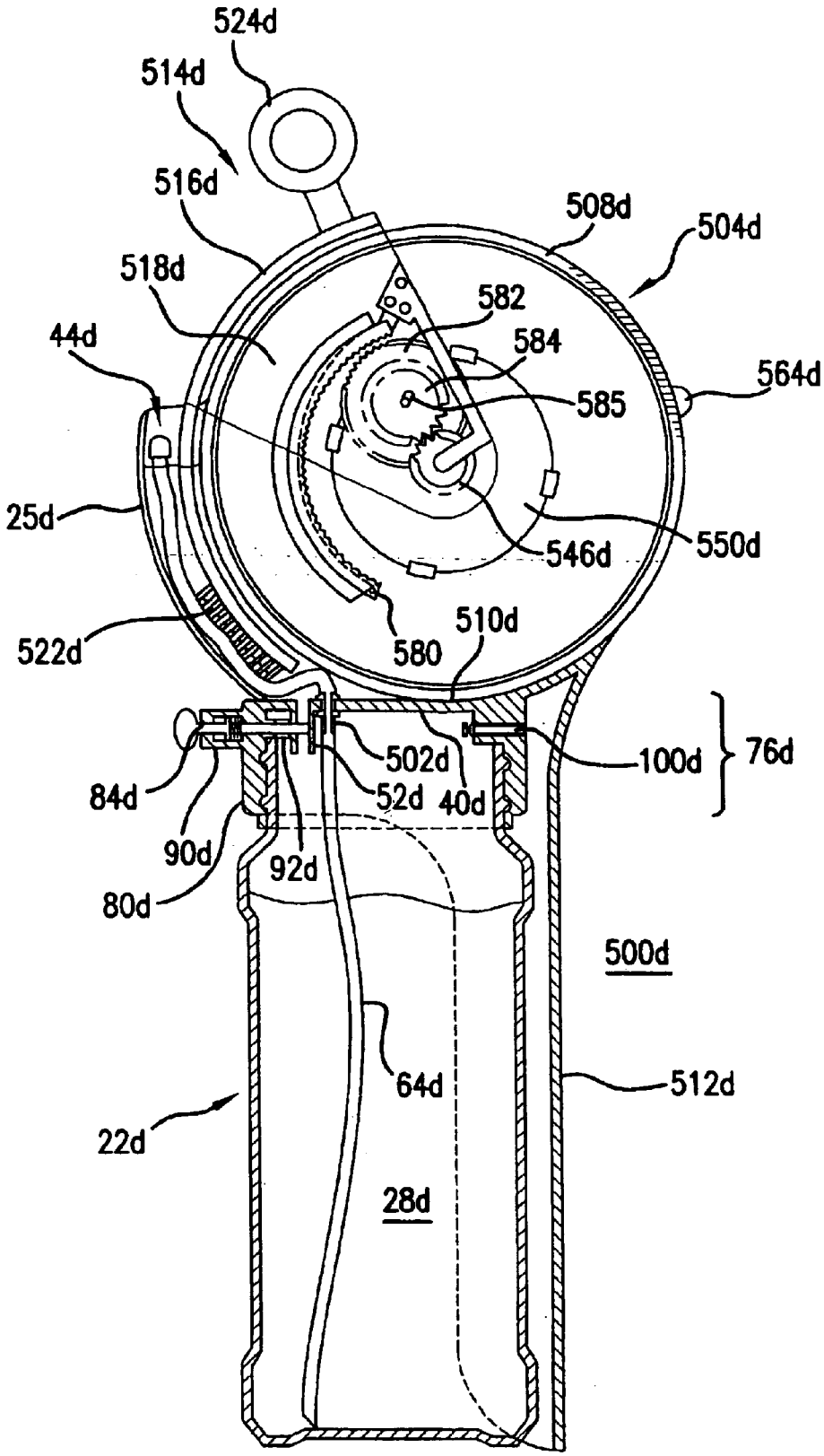
FIG. 16 is a cross-sectional side view of yet another embodiment of a bubble generating assembly that can incorporate the apparatus of FIG. 1, shown in the non-use position.
Figure 17:
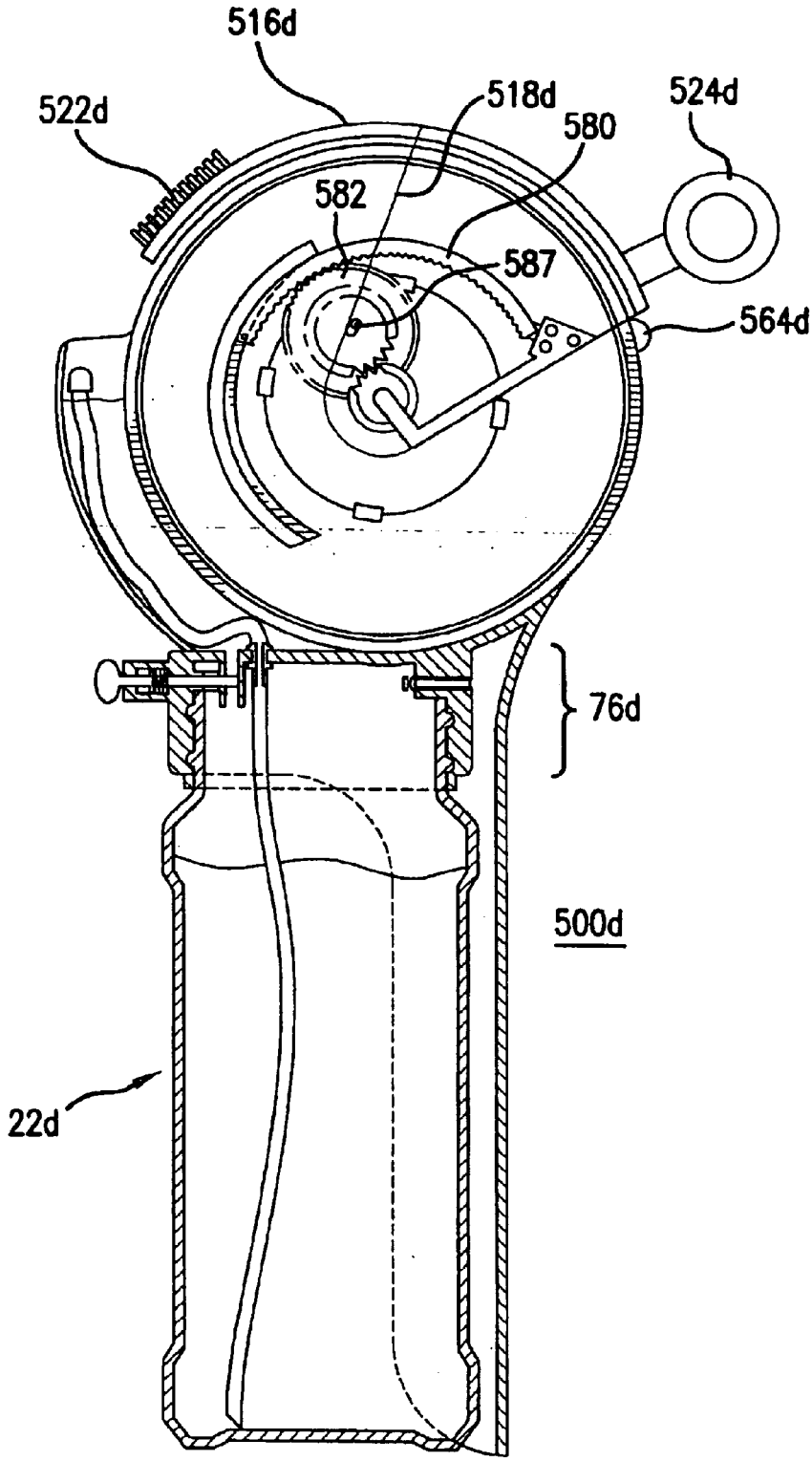
FIG. 17 is a cross-sectional view of the assembly of FIG. 16 shown in the bubble generating position.

FIGS. 16–17 illustrate a bubble generating assembly 500*d* that is very similar to the assembly 500 illustrated in connection with FIGS. 11–14 above, except that the blower (not shown in FIGS. 16 and 17, but is the same as blower 534) in assembly 500*d* is actuated by a manual gear system instead of a battery-operated motor. Therefore, the same numeral designations are used in FIGS. 11–14 and 16–17 to designate the same elements except that a "d" has been added to the designations in FIGS. 16–17.

In the assembly 500*d*, the bubble solution bottle 22*d*, the tube 64*d*, the components of the cylindrical connector 76*d*, the components of the housing 504*d*, the enclosing wall 25*d*, and the components of the lever assembly 514*d* can be identical to the same corresponding elements in the assembly 500, and are therefore not described in greater detail herein. The housing 504*d* retains a gear system that includes a toothed arc 580 that is connected to one side arm 518*d* via a transverse bar (not shown) that extends through one side wall 506*d*. The gear system also includes a first gear 582 having circumferential teeth that engage the teeth of the toothed arc 580, a second gear 584 that is carried on the first gear 582 by a coupling shaft 587, and having circumferential teeth that engage the teeth of a third gear 546*d* that can be the same as the fourth gear 546 in the assembly 500. The third gear 546*d* is positioned at the center of the housing 504*d* along a center-line that connects the center of the side walls 506*d*. A shaft (not shown, but the same as shaft 548) extends along this center line, and extends through the side arms (such as side arms 518), the center of the side walls 506*d*, the center of the third gear 546*d*, and the blower support plate 550*d*. The blower support plate 550*d* carries the blower on one side thereof, and the blower support plate 550*d* is adjacent the third gear 546*d* on the other side thereof. Thus, the shaft couples the third gear 546*d* and the blower for simultaneous rotation.

The second gear 584 has an elongated center hole 585 through which the shaft 587 extends to pivotally couple the gears 582 and 584. The center hole 585 is elongated so that the shaft 587 can travel up and down inside the center hole 585, thereby allowing the first gear 582 that is carried on the shaft 587 to be pushed up and down with respect to the second gear 584.

In operation, the lever assembly 514*d* is normally pivoted forwardly (in a counter-clockwise direction as viewed from the orientation of FIG. 16) so that the bubble ring 522*d* is lowered into a rest or non-use position inside the dipping chamber 44*d*, as shown in FIG. 16. When the user desires to create bubbles, the user grips the handle grip 524*d* and pulls the handle grip 524*d* and the rest of the lever assembly 514*d* rearwardly (in a clockwise direction as viewed from the orientation of FIG. 16) so that the bubble ring 522*d* is raised from the dipping chamber 44*d*. As the lever assembly 514*d* is pulled, the center point (i.e., the shaft 587) of the center hole 585 is moved up within the center hole 585 because the rearward pull of the lever assembly 514*d* will push the third gear 546*d* upwardly, so that the third gear 546*d* will push the second gear 584 and the first gear 582 upwardly. The rearward pull of the lever assembly 514*d* will also pivot the toothed arc 580 rearwardly (compare FIGS. 16 and 17) because the toothed arc 580 is carried by one side arm 518d of the lever assembly 514*d*. Since the first gear 582 is pushed upwardly, the teeth on the first gear 582 will engage the teeth on the toothed arc 580, causing the first and second gears 582 and 584 to rotate, which rotates the third gear 546*d* and the blower support plate 550*d* (and the blower carried thereon), thereby resulting in the generation of a stream of air that is directed through an opening (not shown in FIGS. 16 and 17, but the same as opening 566) in the connecting wall 508d that is aligned with the bubble ring 522*d* when the lever assembly 514*d* has been pivoted to its rearmost position at the stop member 564*d*. See FIG. 17. In addition, when the bubble ring 522*d* is brought up to be aligned with the opening, the bubble ring 522*d* will have a film of bubble solution spread about it as a result of the bubble ring 522*d* being normally immersed in the bubble solution in the dipping chamber 44*d* when in the non-use position. The stream of air from the blower is directed through the opening towards the bubble ring 522*d* to generate bubbles.

When the user pivots the lever assembly 514*d* forwardly again in the counter-clockwise direction as seen in FIG. 16, the center point (i.e., the shaft 587) of the center hole 585 is moved down within the center hole 585 because the forward pivot of the lever assembly 514*d* will push the third gear 546*d* downwardly, so that the third gear 546*d* will push the first gear 582 and second gear 584 downwardly. The forward pivot of the lever assembly 514*d* will also pivot the toothed arc 580 forwardly because the toothed arc 580 is carried by one side arm 518d of the lever assembly 514*d*. Since the second gear 584 is pushed downwardly, the teeth on the first gear 582 will disengage from the teeth on the toothed arc 580, so that the rotation of the first and second gears 582 and 584 will eventually stop, and the blower will eventually stop blowing. At the same time, the forward pivot of the lever assembly 514*d* will bring the bubble ring 522*d* back to the rest or non-use position inside the dipping chamber 44*d*, as shown in FIG. 16.

The bubble solution in the dipping chamber 44*d* can be filled, replenished and drained in the same manner as described above for the assembly 500.

In addition to the above, it is possible to provide all the fans (such as 308, 410, 534 and 534*d*) in a soft material. Conventional fans are typically made of a hard plastic material that suffer from at least two important drawbacks. First, a hard plastic fan poses a safety concern because a child's fingers can be cut or injured if the child sticks a finger at a rotating fan blade. Second, a hard plastic fan is not as durable because the blades of the fan will chip or be damaged if they hit or contact another hard object when they rotate. As a result, the conventional hard fans are typically provided inside the housings of bubble generating assemblies, which means that the fan is usually spaced apart from the bubble ring by a substantial distance. This substantial spacing between the fan and the bubble ring means that a large motor (which requires more power than a smaller motor) must be provided to generate a sufficiently strong blowing force to produce high-quality bubbles at the bubble ring.

In contrast, the fans according to the present invention are made from a soft and flexible material that allows for the blades of the fan to be bent, and examples of these materials can include foam and soft rubber. The soft fans according to the present invention are advantageous to the conventional hard fans because they minimize injury to the user (i.e., a soft blade on a soft fan will not severely impact any object that it contacts during rotation), and are more durable than fans made of hard materials because the soft blades will merely bend (instead of breaking) when they contact another object during rotation. In addition, since the soft fans are not likely to cause injury, the soft fans do not need to be provided in a housing, but can be positioned very close to the bubble rings (e.g., see FIGS. 7–10). For example, each fan 308 and 410 in the assemblies 300 and 400, respectively, in FIGS. 7–10 can be positioned less than one inch from the respective bubble rings 312 and 414. As a result, the present invention can utilize smaller motors that have lower power requirements, thereby reducing the cost of the bubble generating assembly.

Figure 18:
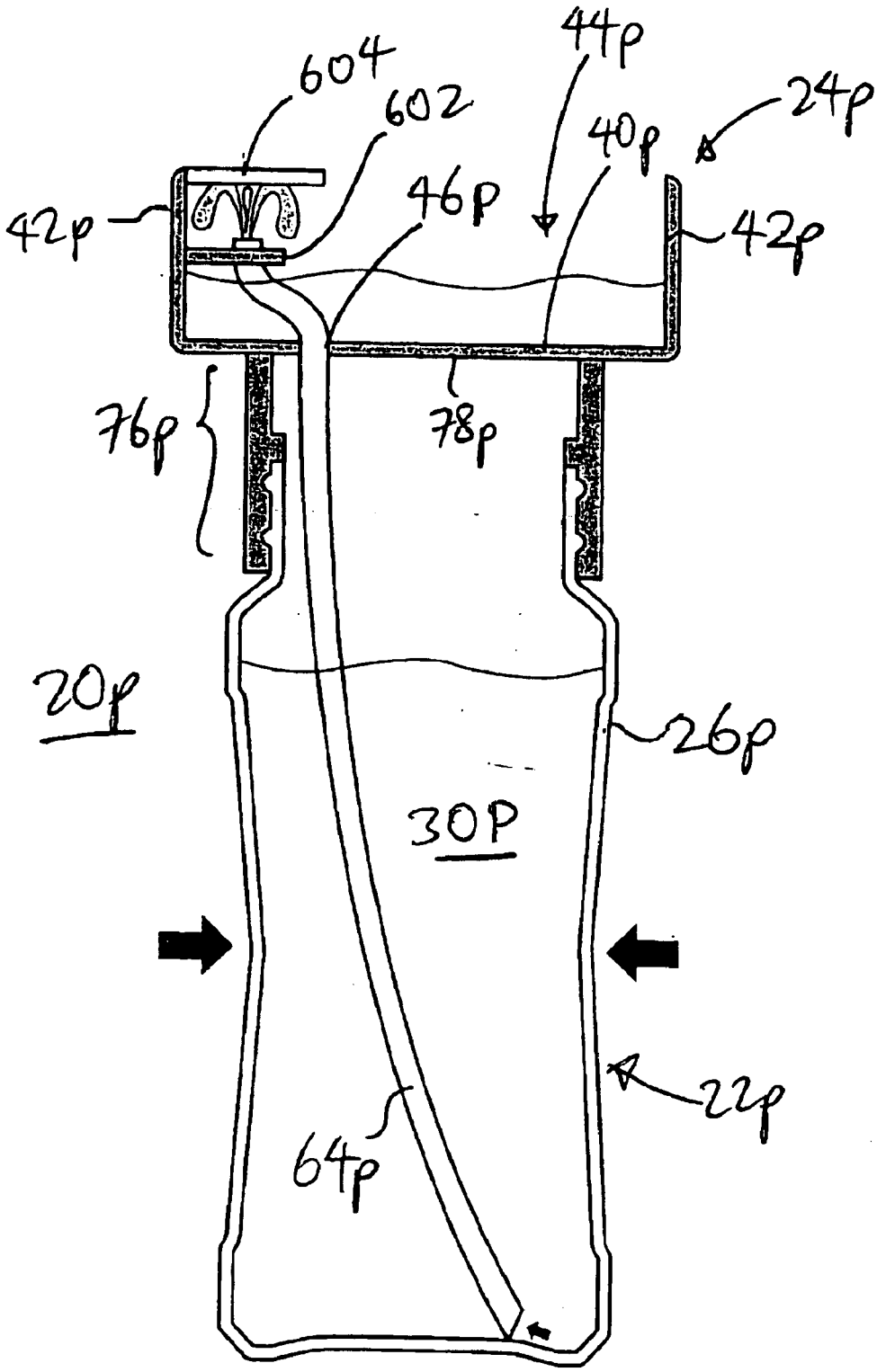
FIG. 18 is a cross-sectional view of an apparatus that delivers bubble solution to a dipping container according to another embodiment of the present invention.

FIG. 18 illustrates an apparatus 20*p* that includes certain modifications to the apparatus 20 in FIGS. 2 and 3. The apparatus 20*p* in FIG. 18 is essentially the same as the apparatus 20 in FIGS. 2–3, so the same numeral designations will be used in both FIGS. 2, 3 and 18 to represent the same elements, except that the designations in FIG. 18 include a "p". The dipping container 24*p*, the bottle 22*p*, and the connector 76*p* can be similar to the dipping container 24, the bottle 22, and the connector 76, except for the modifications noted below. In this embodiment, the supply tube 48 is omitted, and the plastic tube 64*p* extends directly through the opening 46*p* in the bottom plate 40*p* of the dipping container 24*p*. The top end of the plastic tube 64*p* is retained in a fixed position by a holding extension or ridge 602 that extends horizontally and inwardly from the enclosing wall 42*p*. A blocking horizontal ceiling 604 is provided across a portion of the open top of the dipping container 24*p* and positioned above the upper end of the tube 64*p* to deflect bubble solution ejected from the upper end of the tube 64*p* back into the interior of the dipping chamber 44*p*. Although FIG. 18 does not illustrate the connector 76*p* as having a tine suction element 100 or a feedback channel 52, these features are optional and can be included in the apparatus 20*p* if desired.

Figure 19:
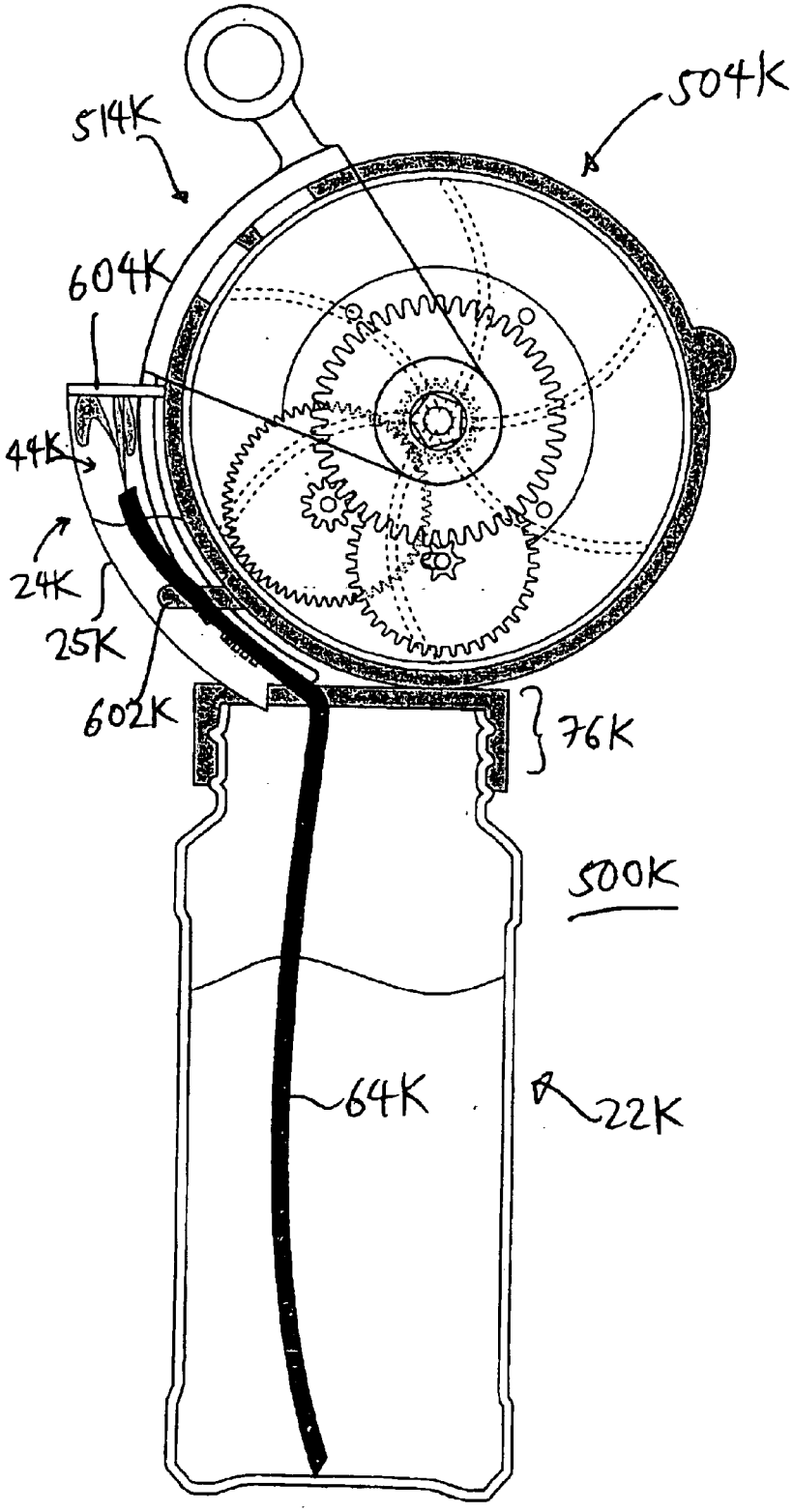
FIG. 19 is a cross-sectional view of an apparatus that delivers bubble solution to a dipping container according to yet another embodiment of the present invention.

The same principles illustrated in FIG. 18 can be extended to the embodiment of FIGS. 11–14. For example, FIG. 19 illustrates an apparatus 500*k* that includes certain modifications to the apparatus 500 in FIGS. 11–14. The apparatus 500*k* in FIG. 18 is essentially the same as the apparatus 500 in FIGS. 11–14, so the same numeral designations will be used in both FIGS. 11–14 and 19 to represent the same elements, except that the designations in FIG. 19 include a "k". The dipping container 24*k*, its enclosing wall 25*k*, the bottle 22*k*, and the tube 64*k* can be the same as the dipping container 24*x*, the enclosing wall 25*x*, the bottle 22*x*, and the tube 64*x*, except for the modifications noted below. In this embodiment, the top end of the plastic tube 64*k* is retained in a fixed position by a holding extension or ridge 602*k* that extends horizontally and inwardly from the enclosing wall 25*k*. A blocking horizontal ceiling 604*k* is provided across a portion of the open top of the dipping container 24*k* and positioned above the upper end of the tube 64*k* to deflect bubble solution ejected from the upper end of the tube 64*k* back into the interior of the dipping chamber 44*k*. Although FIG. 19 does not illustrate the connector 76*k* as having a tine suction element 100 or a feedback channel 52, these features are optional and can be included in the apparatus 500*k* if desired.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating assembly, comprising:

a housing;

a dipping chamber associated with the housing;

a source of bubble solution; and a tube coupling the source of bubble solution with the dipping chamber, the tube having one end positioned inside the dipping chamber;

wherein the housing houses a motor.

2. The assembly of claim 1, further including means for retaining the end of the tube in a fixed position inside the dipping chamber.

3. The assembly of claim 1, wherein the source of bubble solution is a bottle.

4. The assembly of claim 3, further including means for coupling the bottle to the dipping chamber.

5. A bubble generating assembly, comprising:

a housing;

a dipping chamber associated with the housing;

a bottle of bubble solution; and a tube coupling the source of bubble solution with the dipping chamber, the tube having one end positioned inside the dipping chamber;

further including means for venting the interior of the bottle.

6. The assembly of claim 3, wherein the dipping chamber is defined by a bottom plate and an enclosing wall, with an opening provided in the bottom plate.

7. The assembly of claim 6, further including a connector provided adjacent the bottom plate for releasably connecting the bottle to the dipping chamber.

8. A bubble generating assembly, comprising:

a housing;

a dipping chamber associated with the housing;

a source of bubble solution; and a tube coupling the source of bubble solution with the dipping chamber, the tube having one end positioned inside the dipping chamber;

wherein the housing houses a gear system.

9. A bubble generating assembly, comprising:

a housing;

a dipping chamber associated with the housing;

a source of bubble solution; and a tube coupling the source of bubble solution with the dipping chamber, the tube having one end positioned inside the dipping chamber;

wherein the housing houses a power source.

10. The assembly of claim 3, further including a bubble producing device positioned directly above the bottle.

11. The assembly of claim 3, further including an air generator positioned directly above the bottle.

12. The assembly of claim 11, wherein the air generator is positioned inside the housing, and the housing further includes at least one opening and aligned with the air generator.

13. A bubble generating assembly, comprising:

a housing;

a dipping chamber associated with the housing;

a source of bubble solution; and a tube coupling the source of bubble solution with the dipping chamber, the tube having one end positioned inside the dipping chamber;

further including a plurality of bubble producing devices operatively coupled to the housing for simultaneously producing a plurality of separate bubbles.

14. The assembly of claim 3, wherein the housing is positioned directly above the bottle.

15. A bubble generating assembly, comprising:

a housing;

a dipping chamber associated with the housing;

a bottle of bubble solution; and a tube coupling the source of bubble solution with the dipping chamber, the tube having one end positioned inside the dipping chamber;

wherein a majority of the housing is positioned side-by-side with the bottle.

16. A bubble generating assembly, comprising:

a housing;

a dipping chamber associated with the housing;

a source of bubble solution; and a tube coupling the source of bubble solution with the dipping chamber, the tube having one end positioned inside the dipping chamber;

further including a blocking ceiling positioned in the dipping chamber over the end of the tube so as to deflect bubble solution ejected from the end of the tube into the dipping chamber.

17. The assembly of claim 3, wherein pressure is applied to the bottle to deliver bubble solution into the dipping chamber.

* * * * *